US009081335B2

(12) United States Patent
Sugimoto et al.

(10) Patent No.: US 9,081,335 B2
(45) Date of Patent: Jul. 14, 2015

(54) TRANSFER DEVICE WITH TRANSFER VOLTAGE UNIT AND IMAGE FORMING APPARATUS USING THE SAME

(71) Applicants: Naomi Sugimoto, Kanagawa (JP); Shinya Tanaka, Kanagawa (JP); Haruo Iimura, Kanagawa (JP); Shinji Aoki, Osaka (JP); Yasuhiko Ogino, Kanagawa (JP); Keigo Nakamura, Kanagawa (JP)

(72) Inventors: Naomi Sugimoto, Kanagawa (JP); Shinya Tanaka, Kanagawa (JP); Haruo Iimura, Kanagawa (JP); Shinji Aoki, Osaka (JP); Yasuhiko Ogino, Kanagawa (JP); Keigo Nakamura, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 61 days.

(21) Appl. No.: 13/693,304

(22) Filed: Dec. 4, 2012

(65) Prior Publication Data

US 2013/0142531 A1 Jun. 6, 2013

(30) Foreign Application Priority Data

Dec. 6, 2011 (JP) ..... 2011-267168

(51) Int. Cl.
*G03G 15/16* (2006.01)
*G03G 15/01* (2006.01)

(52) U.S. Cl.
CPC ..... *G03G 15/1675* (2013.01); *G03G 15/0189* (2013.01); *G03G 2215/0129* (2013.01)

(58) Field of Classification Search
USPC ..... 399/66, 88
See application file for complete search history.

(56) References Cited

U.S. PATENT DOCUMENTS

| | | | | |
|---|---|---|---|---|
| 3,860,857 | A * | 1/1975 | Namiki et al. | 361/230 |
| 4,896,192 | A * | 1/1990 | Kinoshita | 399/66 |
| 5,146,285 | A * | 9/1992 | Kikuchi et al. | 399/150 |
| 5,991,589 | A * | 11/1999 | Thompson et al. | 399/297 |
| 6,324,359 | B1 | 11/2001 | Nakane | |
| 6,560,436 | B1 * | 5/2003 | Liu | 399/314 |
| 6,766,125 | B1 * | 7/2004 | Izumi | 399/66 |
| 2002/0076228 | A1 * | 6/2002 | Less et al. | 399/66 |
| 2005/0117932 | A1 * | 6/2005 | Takiguchi et al. | 399/101 |

(Continued)

FOREIGN PATENT DOCUMENTS

| | | |
|---|---|---|
| EP | 2 500 782 A2 | 9/2012 |
| JP | 04-045471 | 2/1992 |

(Continued)

OTHER PUBLICATIONS

Extended Search Report issued Jul. 3, 2013 in European Patent Application No. 12195426.7.

(Continued)

*Primary Examiner* — G. M. Hyder
(74) *Attorney, Agent, or Firm* — Oblon, McClelland, Maier & Neustadt, L.L.P.

(57) ABSTRACT

According to an embodiment, provided is a transfer device including: a nip forming member that abuts against a surface of an image carrier carrying a toner image; and a transfer voltage application unit that applies a transfer voltage including a DC component and an AC component. The transfer voltage is an alternating voltage in which a supply voltage having polarity in a transfer direction and a return voltage having polarity opposite. A time average value Vave of the transfer voltage is set to be at polarity in the transfer direction and is set to be closer to a peak value Vt of the supply voltage relative to a center value Voff between a maximum and minimum value. An absolute value of the peak value Vr of the return voltage is set to be larger than an absolute value of the time average value Vave.

19 Claims, 11 Drawing Sheets

(56) References Cited

U.S. PATENT DOCUMENTS

| | | | | |
|---|---|---|---|---|
| 2005/0248904 | A1 | 11/2005 | Kim et al. | |
| 2008/0260401 | A1* | 10/2008 | Shimazaki | 399/66 |
| 2008/0298832 | A1* | 12/2008 | Hara | 399/101 |
| 2010/0303518 | A1 | 12/2010 | Aimoto et al. | |
| 2012/0045231 | A1* | 2/2012 | Ogino et al. | 399/45 |
| 2012/0230715 | A1 | 9/2012 | Ogino et al. | |
| 2012/0237234 | A1 | 9/2012 | Sugimoto et al. | |

FOREIGN PATENT DOCUMENTS

| | | | | |
|---|---|---|---|---|
| JP | 04-086878 | | 3/1992 | |
| JP | 04-086882 | | 3/1992 | |
| JP | 08334954 | A * | 12/1996 | G03G 15/01 |
| JP | 09-106192 | | 4/1997 | |
| JP | 2000-242096 | | 9/2000 | |
| JP | 2006-267486 | | 10/2006 | |
| JP | 2010-281907 | | 12/2010 | |
| JP | 2012-042827 | | 3/2012 | |
| WO | WO2012/128373 | | 9/2012 | |

OTHER PUBLICATIONS

U.S. Appl. No. 13/526,894, filed Jun. 19, 2012, Tomokazu Takeuchi, et al.

U.S. Appl. No. 13/525,681, filed Jun. 18, 2012, Naomi Sugimoto, et al.

U.S. Appl. No. 13/680,629, filed Nov. 19, 2012, Hiromi Ogiyama, et al.

U.S. Appl. No. 13/666,474, filed Nov. 1, 2012, Yasunobu Shimizu, et al.

U.S. Appl. No. 13/602,840, filed Sep. 4, 2012, Keigo Nakamura, et al.

U.S. Appl. No. 13/646,898, filed Oct. 8, 2012, Ryuuichi Mimbu, et al.

U.S. Appl. No. 13/651,776, filed Oct. 15, 2012, Shinya Tanaka, et al.

* cited by examiner

TRANSFER DEVICE WITH TRANSFER VOLTAGE UNIT AND IMAGE FORMING APPARATUS USING THE SAME

CROSS-REFERENCE TO RELATED APPLICATIONS

The present application claims priority to and incorporates by reference the entire contents of Japanese Patent Application No. 2011-267168 filed in Japan on Dec. 6, 2011.

BACKGROUND OF THE INVENTION

1. Field of the Invention

The present invention relates to a transfer device that transfers a toner image on a surface of an image carrier onto a recording material nipped in a transfer nip formed by abutment between the image carrier and a nip forming member, and an image forming apparatus using the transfer device.

2. Description of the Related Art

Known is an image forming apparatus as described in Japanese Patent Application Laid-open No. 2006-267486 as the image forming apparatus of this type. The image forming apparatus forms a toner image on a surface of a drum-like photosensitive element by a well-known electrophotographic process. An endless intermediate transfer belt as an image carrier is made to abut against the photosensitive element so as to form a primary transfer nip. In the primary transfer nip, the toner image on the photosensitive element is primarily transferred onto the intermediate transfer belt. A secondary transfer roller as a nip forming member is made to abut against the intermediate transfer belt so as to form a secondary transfer nip. Furthermore, a secondary transfer opposing roller is arranged in a loop of the intermediate transfer belt. The intermediate transfer belt is nipped between the secondary transfer opposing roller and the above-mentioned secondary transfer roller. An earth is connected to the secondary transfer opposing roller at the inner side of the loop and a secondary transfer voltage is applied to the secondary transfer roller at the outer side of the loop. With this, a secondary transfer electrical field for moving the toner image electrostatically to the secondary transfer roller from the secondary transfer opposing roller is formed between the secondary transfer opposing roller and the secondary transfer roller. Then, the toner image on the intermediate transfer belt is secondarily transferred onto a recording sheet fed into the secondary transfer nip at a timing of being synchronized with the toner image on the intermediate transfer belt with actions of the secondary transfer electric field and a nip pressure.

With this configuration, if a recording sheet with large surface irregularities, such as Japanese paper, is used as the recording sheet, a shading pattern in accordance with the surface irregularities is easily generated on an image. The shading pattern is generated when a sufficient amount of toner is not transferred onto recesses on the sheet surface and image density on the recesses is lower than that on protrusions.

Then, in the image forming apparatus described in Japanese Patent Application Laid-open No. 2006-267486, as the secondary transfer voltage, not a voltage composed of a DC component only but an AC voltage in which an AC component is superimposed on the DC component is applied. According to Japanese Patent Application Laid-open No. 2006-267486, although specific reasons have not been disclosed, by using the secondary transfer voltage, toner reciprocates between the surface recesses on the recording material and the image carrier, so that the toner can make contact with the surface recesses on the recording material. This makes it possible to suppress transfer failure of the toner onto the surface recesses on the recording material. In addition, in Japanese Patent Application Laid-open No. 2006-267486 discloses an experimental result indicating that if such a secondary transfer voltage is applied, generation of the shading pattern can be suppressed in comparison with a case where the secondary transfer voltage composed of the DC component only is applied.

However, the applicants have found by experiments that a sufficient image density cannot be obtained on the recesses on the surface of a recording sheet in some cases with the configuration disclosed in Japanese Patent Application Laid-open No. 2006-267486. The applicants have explored the reasons therefor and have found the following fact, which will be described in detail with reference to some drawings.

FIG. 1 is an enlarged configuration view illustrating an example of a secondary transfer nip.

In FIG. 1, an intermediate transfer belt 531 is pressurized toward a secondary transfer roller 536 with a secondary transfer opposing roller 533. The secondary transfer opposing roller 533 abuts against a rear surface of the intermediate transfer belt 531. With the pressurization, a secondary transfer nip on which a surface of the intermediate transfer belt 531 and the secondary transfer roller 536 abut against each other is formed. A toner image on the intermediate transfer belt 531 is secondarily transferred onto a recording sheet P fed to the secondary transfer nip. A secondary transfer voltage for secondarily transferring the toner image is applied to any one of the secondary transfer opposing roller 533 and the secondary transfer roller 536 and the other of them is grounded. While the toner image can be transferred onto the recording sheet P when the transfer voltage is applied to any of the rollers, a case where the secondary transfer voltage is applied to the secondary transfer opposing roller 533 and toner having negative polarity is used is described as an example. In this case, in order to move the toner in the secondary transfer nip to the secondary transfer roller 536 from the secondary transfer opposing roller 533, a voltage of which time average value is at the negative polarity, which is the same as the polarity of the toner, is applied as the secondary transfer voltage as an alternating voltage.

FIG. 2 is a waveform chart illustrating an example of the waveform of the secondary transfer voltage to be applied to the secondary transfer opposing roller 533.

The waveform of the secondary transfer voltage is a sine wave as illustrated in FIG. 2 and the reference symbol "Vave" in FIG. 2 indicates a time average value of the secondary transfer voltage. The reference symbol "Vt" in FIG. 2 indicates a peak value of a voltage (hereinafter, referred to as "supply voltage") having polarity (negative polarity) in the transfer direction in which the toner is transferred onto the recording sheet P from the intermediate transfer belt 531 in the secondary transfer nip. The reference symbol "Vr" in FIG. 2 indicates a peak value of a voltage (hereinafter, referred to as "return voltage") having polarity (positive polarity) in the direction in which the toner is returned to the intermediate transfer belt 531 from the recording sheet P in the secondary transfer nip.

When an AC voltage having the AC component only without the DC component is used as the secondary transfer voltage, the toner can be made to reciprocate between the intermediate transfer belt 531 and the recording sheet in the secondary transfer nip. However, with the AC voltage having no DC component, the toner is made to reciprocate simply and cannot be transferred onto the recording sheet P. Therefore, a voltage in which the AC voltage is superimposed on the DC component is required to be used as the secondary transfer voltage and the time average value Vave of the secondary transfer voltage is required to be set to be at the polarity (negative polarity) in the transfer direction in which the toner is transferred onto the recording sheet P from the intermediate transfer belt 531. With this, the toner can be made into a state of being transferred onto the recording sheet P after having passed through the secondary transfer nip while reciprocating between the intermediate transfer belt 531 and the recording sheet.

The applicants have observed the reciprocating movement of the toner with experimental devices and have found the following fact.

If the secondary transfer voltage is started to be applied, first, only an extremely small amount of toner particles present on a surface of a toner layer on the intermediate transfer belt 531 escape from the toner layer so as to move toward recesses on a surface of a recording sheet with an action of an electric field when a supply voltage is applied. At this time, almost all of the toner particles in the toner layer still remain in the toner layer. The extremely small amount of toner particles having escaped from the toner layer enter the recesses on the surface of the recording sheet, and then, return back to the toner layer from the recesses with an action of an electric field when a return voltage is applied. At this time, the returning toner particles collide with the toner particles remaining in the toner layer, so that the adhesive force of the toner particles in the toner layer is weakened. Then, when the supply voltage is applied next, more toner particles than those in the first time escape from the toner layer so as to move toward the recesses on the surface of the recording sheet. If such a series of behavior is repeated, the number of toner particles that escape from the toner layer and enter the recesses on the surface of the recording sheet P increases gradually. As a result, a sufficient amount of toner particles are transferred into the recesses on the surface of the recording sheet P and generation of a shading pattern in accordance with the surface irregularities of the recording sheet P on an image can be suppressed.

Furthermore, the applicants have found that transfer performance onto the recesses have a high correlation with the peak value Vr of the return voltage from results of experiments performed by using various types of recording materials. That is to say, while one tries to obtain a sufficient image density even on the recesses, unless the peak value Vr of the return voltage is large to some extent, the sufficient transfer performance onto the recesses is not obtained and the image density on the recesses is insufficient even if other devises including an increase in the application time of the peak value Vr of the return voltage are made. The reason for this is as follows.

In order to obtain high transfer performance onto the recesses, it is insufficient that the toner moved to the recording material is returned back to the image carrier with the return voltage only, and the returned toner is required to be made to collide with the toner layer on the image carrier so as to weaken the adhesive force of the toner in the toner layer. Otherwise, the same toner particles reciprocate only and the number of toner particles that escape from the toner layer and enter the recesses on the surface of the recording material cannot gradually increase. That is to say, the key to obtain high transfer performance onto the recesses is to generate collision that is strong enough to weaken the adhesive force of the toner in the toner layer on the image carrier with the toner returned back from the recording material. Furthermore, the strength of the collision depends on the peak value Vr of the return voltage. The above-described collision cannot be generated unless the peak value Vr of the return voltage is large to some extent.

The above-mentioned reason was first found by the applicants through observation of the above-mentioned reciprocating movement with experimental devices.

The applicant has developed a technique in which a peak-to-peak voltage of an AC component of a secondary transfer voltage is set to a value that is larger than four times the absolute value of a DC component in Japanese Patent Application No. 2010-183301 (hereinafter, referred to as "previous application"). If the secondary transfer voltage is applied, the peak value Vr of the return voltage becomes large sufficiently. Therefore, sufficient transfer performance onto the recesses on the recording material is obtained, so that image density of the recesses can be enhanced sufficiently.

However, as a result of further studies by the applicants, with the configuration disclosed in the above-mentioned previous application, a plurality of white spots are generated on an image generated on the recording material in some cases. The applicants have explored the reason why the white spots are generated and have found the following fact.

In order to form an image having high image quality on a recording material with irregularities on a surface thereof, sufficient transfer performance is required to be obtained on both the recesses and the protrusions on the surface. The transfer performance onto the protrusions depends on a time average value Vave of a secondary transfer voltage when the secondary transfer voltage in which an AC component is superimposed on a DC component is applied. That is to say, high transfer performance onto the protrusions cannot be obtained and a sufficient image density cannot be obtained on the protrusions unless the absolute value of the time average value Vave of the secondary transfer voltage is increased and is set to sufficiently large to polarity in which the toner is transferred onto the recording material from the image carrier.

With the configuration disclosed in the previous application, in order to obtain high transfer performance onto the recesses, the peak-to-peak voltage of the AC component of the secondary transfer voltage is set to be a value that is more than four times the absolute value of the DC component. The waveform of the secondary transfer voltage used in the configuration is a sine wave. Therefore, the DC component of the secondary transfer voltage is identical to the time average value Vave of the secondary transfer voltage. Accordingly, in the configuration disclosed in the previous application, if the absolute value of the time average value Vave of the secondary transfer voltage (absolute value of the DC component) is set to be large in order to obtain high transfer performance onto the protrusions, the peak-to-peak voltage of the AC component also increases in accordance therewith.

The peak-to-peak voltage of the AC component is identical to a differential value between the peak value Vt of the supply voltage and the peak value Vr of the return voltage. Therefore, if the peak-to-peak voltage increases, the peak value Vr of the return voltage becomes a sufficiently large value and high transfer performance onto the recesses can be obtained. However, as the peak-to-peak voltage increases, the peak value Vt of the supply voltage also increases. In particular, when the secondary transfer voltage is a voltage in which the AC component having a sine wave is superimposed on the DC component as in the configuration disclosed in the previous application, the peak value Vt of the supply voltage is the sum of a value that is half the peak-to-peak voltage of the AC component and the absolute value of the DC component. Therefore, if the absolute value of the DC component increases and the peak-to-peak voltage of the AC component also increases in accordance therewith so as to obtain a sufficiently large peak value Vr of the return voltage, the absolute value of the peak value Vt of the supply voltage will indicate an extremely large value.

If the absolute value of the peak value Vt of the supply voltage indicates a large value, electric discharge is generated in the transfer nip during an application period of the supply voltage. When the electric discharge is generated, the toner that has received the electric discharge is charged to have polarity opposite to normal charged polarity on the electric discharge generation places, for example. For these reasons, the toner does not adhere onto the recording material. Therefore, white spots appear on portions of the image that correspond to the electric discharge generation places. In this sense, the configuration disclosed in the previous application can make it difficult to obtain sufficient image densities on both the protrusions and the recesses on the recording material.

In view of the foregoing, there is a need to provide a transfer device and an image forming apparatus that can obtain sufficient image densities on both the recesses and the protrusions on a surface of a recording material with large surface irregularities without generating white spots (white out) in an image when the image is formed on the recording material.

SUMMARY OF THE INVENTION

It is an object of the present invention to at least partially solve the problems in the conventional technology.

According to an embodiment, provided is a transfer device including: a nip forming member that abuts against a surface of an image carrier carrying a toner image so as to form a transfer nip; and a transfer voltage application unit that applies a transfer voltage to the transfer nip, the transfer voltage including a DC component and an AC component for transferring the toner image on the image carrier onto a recording material nipped in the transfer nip. When the toner image on the image carrier is transferred onto the recording material, the transfer voltage is an alternating voltage in which a supply voltage having polarity in a transfer direction in which the toner image is transferred onto the recording material from the image carrier and a return voltage having polarity opposite to the supply voltage are switched alternately, a time average value Vave of the transfer voltage is set to be at polarity in the transfer direction in which the toner image is transferred onto the recording material from the image carrier and is set to be closer to a peak value Vt of the supply voltage relative to a center value Voff between a maximum value and a minimum value of the transfer voltage, and an absolute value of the peak value Vr of the return voltage is set to be larger than an absolute value of the time average value Vave.

According to another embodiment, provided is an image forming apparatus including: a transfer unit that transfers a toner image carried on a surface of an image carrier onto a recording material nipped into a transfer nip formed by abutment between the image carrier and a nip forming member. The transfer device mentioned above is used as the transfer unit.

As a result of experiments performed by the applicants, if the absolute value of the peak value (Vr) of the return voltage is set to be larger than at least the absolute value of the time average value (Vave), sufficient transfer performance onto recesses on the recording material can be obtained as in the configuration disclosed in the above-mentioned previous application. If the absolute value of the peak value (Vr) of the return voltage is set to be larger by at least an increased amount of the absolute value of the time average value (Vave), sufficient transfer performance onto the recesses on the recording material is ensured for the following reasons. The time average value (Vave) of the transfer voltage is set to be at the polarity in the transfer direction in which the toner image is transferred onto the recording material from the image carrier. Therefore, until the recording material passes through the transfer nip, an electric field at the supply side when the toner is moved to the recording material acts on the toner to a relatively large extent in comparison with an electric field at the return side when the toner is moved to the image carrier. Therefore, if only the absolute value of the time average value (Vave) increases while the absolute value of the peak value (Vr) of the return voltage is kept, a gap widens between the action of the electric field at the return side when the toner is moved to the image carrier and the action of the electric field at the supply side when the toner is moved to the recording material. Therefore, it becomes difficult to cause the toner moved the recording material to collide with a toner layer on the image carrier sufficiently. This arises a risk that sufficient transfer performance onto the recesses on the recording material is not obtained. As in the embodiment, with a configuration in which the absolute value of the peak value (Vr) of the return voltage is set to be larger than the absolute value of the time average value (Vave), as the absolute value of the time average value (Vave) increases, the absolute value of the peak value (Vr) of the return voltage also increases. Therefore, even if the absolute value of the time average value (Vave) increases, sufficient transfer performance onto the recesses on the recording material can be ensured. As a result, according to the embodiment, even if the absolute value of the time average value (Vave) is set to be large in order to obtain sufficient transfer performance onto protrusions on the recording material, sufficient transfer performance onto the recesses can be ensured. Therefore, high image densities can be obtained on both the protrusions and the recesses on the recording material.

In addition, in the embodiment, the time average value (Vave) of the transfer voltage is set to be closer to the peak value (Vt) of the supply voltage relative to the center value (Voff) (hereinafter, referred to as "offset voltage") between a maximum value and a minimum value of the transfer voltage. With this, when the absolute value of the time average value (Vave) is set to be large in order to obtain the sufficient transfer performance onto the protrusions on the recording material, the absolute value of the peak value (Vr) of the return voltage can be made large in a state where the absolute value of peak value (Vt) of the supply voltage is limited to be equal to or smaller than a predetermined upper limit value. As a result, if the upper limit value of the absolute value of peak value (Vt) of the supply voltage is set appropriately in accordance with an electric discharge start voltage value at which an electric discharge is generated, the absolute value of the peak value (Vr) of the return voltage can be made large without generating an electric discharge. Therefore, according to the embodiment, both the absolute value of the time average value (Vave) and the absolute value of the peak value (Vr) of the return voltage are set to be large so as to obtain high image densities on both the protrusions and the recesses on the recording material. At the same time, the absolute value of the peak value (Vt) of the supply voltage can be suppressed so as to prevent an electric discharge from being generated and suppress generation of white spots (white out) due to the electric discharge.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, as an image forming apparatus, an embodiment of an electrophotographic color printer (hereinafter, referred to as printer simply) is described.

First, a basic configuration of the printer according to the embodiment is described.

Figure 1:
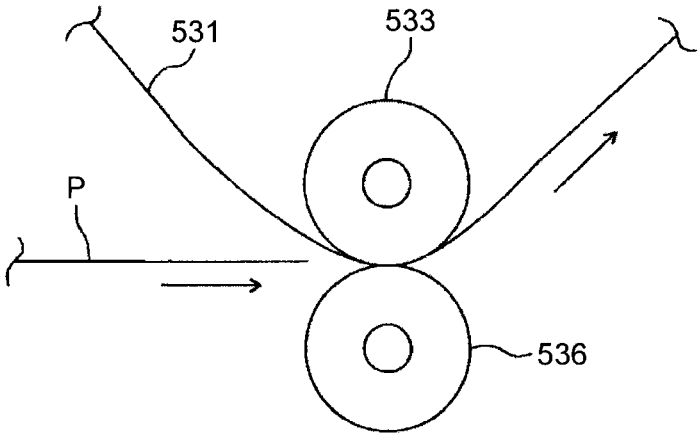
FIG. 1 is an enlarged configuration view illustrating an example of a secondary transfer nip.
Figure 2:
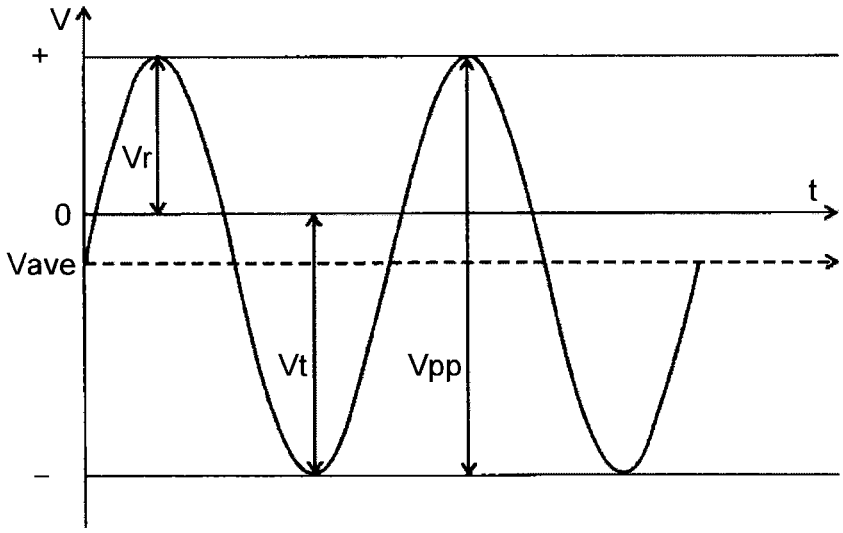
FIG. 2 is a waveform chart illustrating an example of the waveform of a transfer voltage in which an AC component is superimposed on a DC component.
Figure 3:
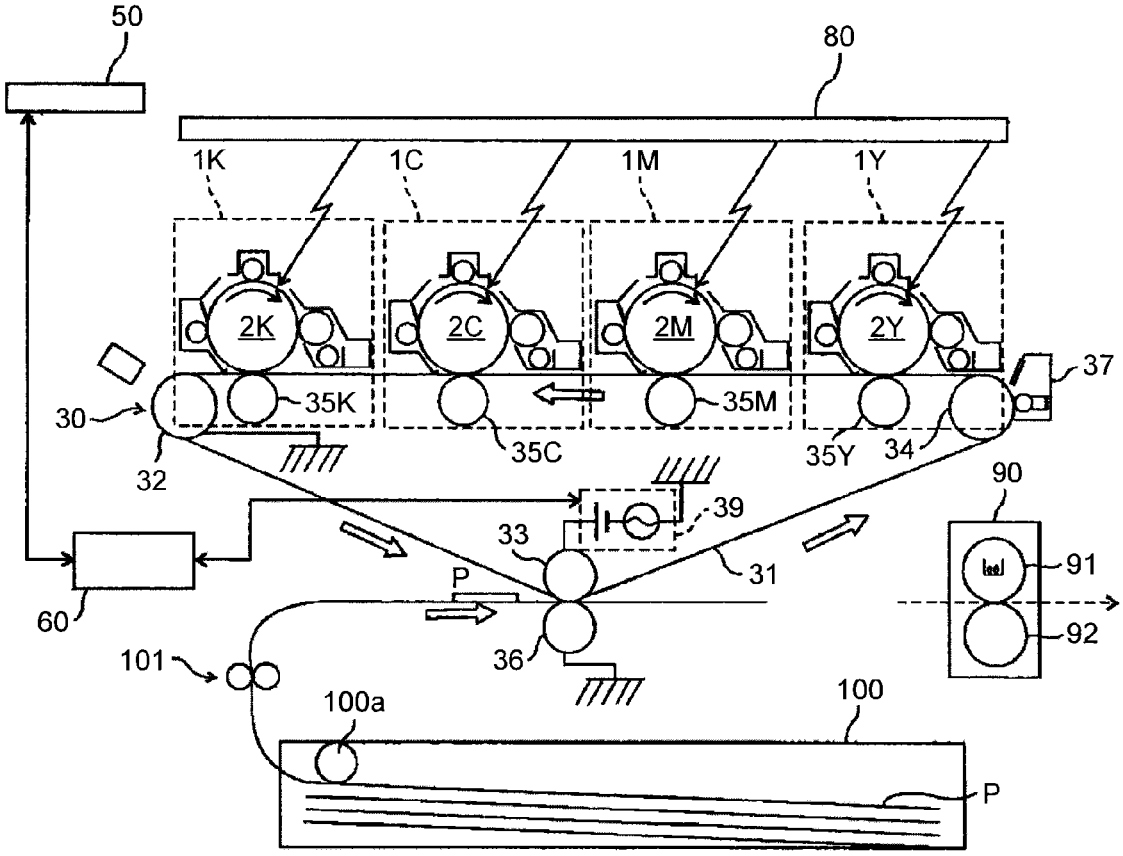
FIG. 3 is a schematic configuration view illustrating a printer according to an embodiment.

FIG. 3 is a schematic configuration view illustrating the printer according to the embodiment.

In FIG. 3, the printer according to the embodiment includes four image forming units 1Y, 1M, 1C, and 1K, a transfer unit 30 as a transfer device, an optical writing unit 80, a fixing device 90, a paper cassette 100, and a pair of registration rollers 101. The image forming units 1Y, 1M, 1C, and 1K form toner images of yellow (Y), magenta (M), cyan (C), and black (K), respectively.

Figure 4:
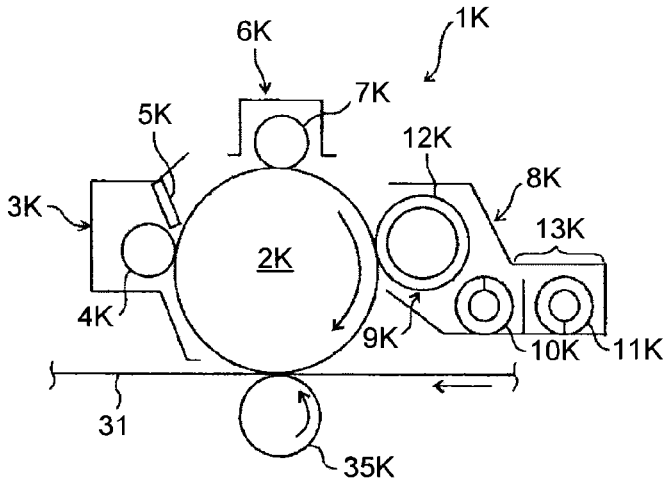
FIG. 4 is an enlarged configuration view illustrating an image forming unit for K on the printer in an enlarged manner.

The four image forming units 1Y, 1M, 1C, and 1K use Y, M, C, and K toners of different colors as image formation substances, respectively. The image forming units 1Y, 1M, 1C, and 1K have the same configuration other than the toners and are replaced when lifetime has expired. The image forming unit 1K for forming a K toner image is described as an example. As illustrated in FIG. 4, the image forming unit 1K includes a drum-like photosensitive element 2K as a latent image carrier, a drum cleaning device 3K, a neutralization device (not illustrated), a charging device 6K, and a developing device 8K, for example. These devices are held by a common holding member and are integrally attached to a printer main body in a detachable manner so as to be exchanged at the same time.

The photosensitive element 2K is a member obtained by forming an organic photosensitive layer on a surface of a drum-like base body. The photosensitive element 2K is driven rotationally in the clockwise direction in FIG. 4 by a driving unit (not illustrated). The charging device 6K generates electric discharge between a roller charging device 7K and the photosensitive element 2K while making the roller charging device 7K to which charging bias is applied contact or close to the photosensitive element 2K so as to charge a surface of the photosensitive element 2K uniformly. In the printer, the surface of the photosensitive element 2K is charged to have negative polarity, which is the same as normal charged polarity of the toner uniformly. To be more specific, the surface of the photosensitive element 2K is charged to approximately −650 V uniformly. As the charging bias, an AC voltage superimposed on a DC voltage is employed. The roller charging device 7K is obtained by coating a surface of a cored bar made of a metal with a conductive elastic layer made of a conductive elastic material. Instead of a method in which the charging member such as the roller charging device is made contact or close to the photosensitive element 2K, a method by using an electric charger may be employed.

The surface of the photosensitive element 2K that has been charged uniformly is scanned optically with laser light emitted from an optical writing unit, which will be described later, so as to carry an electrostatic latent image for K. A potential of the electrostatic latent image for K is approximately −100 V. The electrostatic latent image for K is developed by the developing device 8K using K toner (not illustrated) so as to form a K toner image. Then, the K toner image is primarily transferred onto an intermediate transfer belt 31, which will be described later.

The drum cleaning device 3K removes transfer residual toner adhered to the surface of the photosensitive element 2K that has experienced a primary transfer process (has passed through a primary transfer nip, which will be described later). The drum cleaning device 3K includes a cleaning brush roller 4K that is driven rotationally and a cleaning blade 5K that makes a free end thereof abut against the photosensitive element 2K in a state of being supported in a cantilevered manner. The transfer residual toner is wiped out from the surface of the photosensitive element 2K with the cleaning brush roller 4K that rotates and is scraped away from the surface of the photosensitive element 2K with the cleaning blade. It is to be noted that the cleaning blade is made to abut against the photosensitive element 2K in the counter direction such that an end supported in the cantilevered manner is directed to the downstream side in the drum rotating direction relative to the free end thereof.

The neutralization device neutralizes remaining charges on the photosensitive element 2K after being cleaned by the drum cleaning device 3K. With the neutralization, the surface of the photosensitive element 2K is initialized so as to be prepared for subsequent image formation.

The developing device 8K includes a developing unit 12K incorporating a developing roller 9K and a developer conveying unit 13K that conveys a K developer (not illustrated) in a stirring manner. Furthermore, the developer conveying unit 13K includes a first conveyance chamber accommodating a first screw member 10K and a second conveyance chamber accommodating a second screw member 11K. Each of these screw members includes a rotating shaft member of which both ends in the shaft line direction are supported by bearings in a freely rotatable manner and a spiral blade that is provided so as to project on a circumferential surface of the rotating shaft member in a spiral manner.

The first conveyance chamber accommodating the first screw member 10K and the second conveyance chamber accommodating the second screw member 11K are partitioned by a partition wall. Communication ports for communicating both conveyance chambers are formed on both end portions of the partition wall in the screw shaft line direction. The first screw member 10K conveys the K developer (not illustrated) held in the spiral blade to the front side from the rear side in the direction orthogonal to a paper plane in FIG. 4 while stirring the K developer in the rotating direction with rotational driving. The first screw member 10K and the developing roller 9K, which will be described later, are arranged in parallel in postures of being opposed to each other. Therefore, the conveying direction of the K developer in this case also corresponds to a direction along the rotating shaft line direction of the developing roller 9K. Furthermore, the first screw member 10K supplies the K developer to the surface of the developing roller 9K along the shaft line direction thereof.

The K developer conveyed to the vicinity of a front-side end portion of the first screw member 10K in FIG. 4 passes through the communication port provided in the vicinity of the front-side end portion of the partition wall in FIG. 4 and enters the second conveyance chamber. Thereafter, the K developer is held in the spiral blade of the second screw member 11K. Then, the K developer is conveyed from the front side to the rear side in FIG. 4 while being stirred in the rotating direction with rotational driving of the second screw member 11K.

In the second conveyance chamber, a toner density sensor (not illustrated) is provided on a lower wall of a casing so as to detect K toner density of the K developer in the second conveyance chamber. The K toner density sensor formed by a magnetic permeability sensor is used. A magnetic permeability of the K developer containing the K toner and a magnetic carrier has a correlation with the K toner density. Therefore, it is considered that the magnetic permeability sensor detects the K toner density.

In the printer, Y, M, C, and K toner replenishing units (not illustrated) for replenishing Y, M, C, and K toners into the second accommodation chambers of the developing devices for Y, M, C, and K individually are provided. Furthermore, a control unit of the printer stores Vtref for Y, M, C, and K as target values of output voltage values from the Y, M, C, and K toner density sensors in the RAM. When differences between the output voltage values from the Y, M, C, and K toner density sensors and the values Vtref for Y, M, C, and K are larger than predetermined values, the Y, M, C, and K toner replenishing units are driven for an amount of time in accordance with the differences. With this, the Y, M, C, and K toners are replenished into the second conveyance chambers on the developing devices for Y, M, C, and K, respectively.

The developing roller 9K accommodated in the developing unit 12K is opposed to the first screw member 10K, and is also opposed to the photosensitive element 2K through an opening provided on the casing. Furthermore, the developing roller 9K includes a cylindrical developing sleeve formed by a non-magnetic pipe that is driven rotationally and a magnet roller fixed into the developing sleeve so as not to move with the sleeve. The developing roller 9K conveys the K developer to be supplied from the first screw member 10K to a developing region opposed to the photosensitive element 2K with the rotation of the sleeve while carrying the K developer on a sleeve surface with a magnetic force generated by the magnet roller.

A developing bias that has the same polarity as the toner, is larger than the potential of the electrostatic latent image of the photosensitive element 2K, and is smaller than a uniform charged potential of the photosensitive element 2K is applied to the developing sleeve. With this, a developing potential that causes the K toner on the developing sleeve to move toward the electrostatic latent image electrostatically acts on between the developing sleeve and the electrostatic latent image on the photosensitive element 2K. Furthermore, a non-developing potential that causes the K toner on the developing sleeve to move toward the sleeve surface acts on between the developing sleeve and a ground portion of the photosensitive element 2K. With the actions of the developing potential and the non-developing potential, the K toner on the developing sleeve is transferred onto the electrostatic latent image on the photosensitive element 2K selectively, so that the electrostatic latent image is developed to the K toner image.

In FIG. 3 as illustrated above, on the image forming units 1Y, 1M, and 10 for Y, M, and C, Y, M, C toner images are formed on photosensitive elements 2Y, 2M, and 2C, respectively, in the same manner as the image forming unit 1K for K.

The optical writing unit 80 as a latent image writing unit is arranged above the image forming units 1Y, 1M, 1C, and 1K. The optical writing unit 80 scans the photosensitive elements 2Y, 2M, 2C, and 2K optically with laser light emitted from a laser diode based on image information transmitted from an external apparatus such as a personal computer. With the optical scanning, electrostatic latent images for Y, M, C, and K are formed on the photosensitive elements 2Y, 2M, 2C, and 2K, respectively. To be more specific, a potential of a portion onto which the laser light has been irradiated on an overall region of the surface of the photosensitive element 2Y that has been charged uniformly is attenuated. Therefore, an electrostatic latent image of which potential on the laser irradiation portion is smaller than that on portions (ground portions) other than the laser irradiation portion is obtained. It is to be noted that the optical writing unit 80 irradiates laser light L emitted from a light source onto each of the photosensitive elements through a plurality of optical lenses and mirrors while polarizing the laser light L in the main scanning direction by a polygon mirror that is driven rotationally by a polygon motor (not illustrated). Alternatively, a member that performs optical writing with LED light emitted from a plurality of LEDs of an LED array may be employed.

The transfer unit 30 as the transfer device is arranged below the image forming units 1Y, 1M, 1C, and 1K. The transfer unit 30 moves the endless intermediate transfer belt 31 endlessly in the counterclockwise direction in FIG. 3 while suspending the intermediate transfer belt 31 in a tension manner. The transfer unit 30 includes a driving roller 32, a secondary transfer opposing roller 33, a cleaning backup roller 34, four primary transfer rollers 35Y, 35M, 35C, and 35K, a secondary transfer roller 36, and a belt cleaning device 37 in addition to the intermediate transfer belt 31 as the image carrier.

The intermediate transfer belt 31 is suspended in a tension manner by the driving roller 32, the secondary transfer opposing roller 33, the cleaning backup roller 34, and the four primary transfer rollers 35Y, 35M, 35C, and 35K that are arranged at the inner side of the loop thereof. Further, the intermediate transfer belt 31 is moved endlessly in the same direction by a rotating force of the driving roller 32 that is driven rotationally in the counterclockwise direction in FIG. 3 by a driving unit (not illustrated).

The four primary transfer rollers 35Y, 35M, 35C, and 35K nip the intermediate transfer belt 31 that is moved endlessly together with the photosensitive elements 2Y, 2M, 2C, and 2K therebetween. With this, primary transfer nips for Y, M, C, and K at which a front surface of the intermediate transfer belt 31 and the photosensitive elements 2Y, 2M, 2C, and 2K abut against each other, respectively, are formed. A primary transfer voltage is applied to each of the primary transfer rollers 35Y, 35M, 35C, and 35K by a transfer voltage power supply (not illustrated). With the application, transfer electric fields are formed between the Y, M, C, and K toner images on the photosensitive elements 2Y, 2M, 2C, and 2K and the primary transfer rollers 35Y, 35M, 35C, and 35K, respectively. The Y toner image formed on the surface of the photosensitive element 2Y for Y enters the primary transfer nip for Y with the rotation of the photosensitive element 2Y. Then, the Y toner image is transferred primarily onto the intermediate transfer belt 31 from the photosensitive element 2Y with actions of the transfer electric field and a nip pressure. Thereafter, the intermediate transfer belt 31 onto which the Y toner image has been transferred primarily in the above-mentioned manner passes through the primary transfer nips for M, C, and K sequentially. Then, the M, C, and K toner images on the photosensitive elements 2M, 2C, and 2K, respectively, are transferred primarily on the Y toner image in a superimposed manner sequentially. With the primary transfer in the superimposed manner, a four-color-superimposed toner image is formed on the intermediate transfer belt 31.

Each of the primary transfer rollers 35Y, 35M, 35C, and 35K is formed by an elastic roller including a cored bar made of a metal and a conductive sponge layer fixed onto a surface of the cored bar. The primary transfer rollers 35Y, 35M, 35C, and 35K are arranged such that shaft cores of the primary transfer rollers 35Y, 35M, 35C, and 35K are located at positions deviated to the downstream side in the belt movement direction by approximately 2.5 mm relative to shaft cores of the photosensitive elements 2Y, 2M, 2C, and 2K, respectively. The primary transfer voltage is applied to each of the primary transfer rollers 35Y, 35M, 35C, and 35K under constant current control. It is to be noted that transfer chargers or transfer brushes can be used instead of the primary transfer rollers 35Y, 35M, 35C, and 35K.

The secondary transfer roller 36 of the transfer unit 30 is arranged at the outer side of the loop of the intermediate transfer belt 31 and nips the intermediate transfer belt 31 together with the secondary transfer opposing roller 33 at the inner side of the loop. With this, a secondary transfer nip at which the front surface of the intermediate transfer belt 31 and the secondary transfer roller 36 abut against each other is formed. The secondary transfer roller 36 is grounded while a secondary transfer voltage is applied to the secondary transfer opposing roller 33 with a secondary transfer power supply 39. With the application, a secondary transfer electric field is formed between the secondary transfer opposing roller 33 and the secondary transfer roller 36. The secondary transfer electric field causes the toner having negative polarity to be moved to the secondary transfer roller 36 from the secondary transfer opposing roller 33 electrostatically.

The paper cassette 100 that accommodates a plurality of recording sheets P stacked in a pile is arranged below the transfer unit 30. The paper cassette 100 causes a paper feeding roller 100*a* to abut against the recording sheet P at the top of the pile. The paper feeding roller 100*a* is driven rotationally at a predetermined timing so as to convey the recording sheet P to a conveying path. The pair of registration rollers 101 are arranged in the vicinity of a terminal end of the conveying path. The pair of registration rollers 101 stop rotation of both the rollers immediately after having nipped the recording sheet P fed from the paper cassette 100 between the rollers. Then, the pair of registration rollers 101 restart the rotational driving at a timing when the nipped recording sheet P is capable of being synchronized with the four-color-superimposed toner image on the intermediate transfer belt 31 in the secondary transfer nip, and conveys the recording sheet P toward the secondary transfer nip. The four-color-superimposed toner image on the intermediate transfer belt 31 that has been made to adhere to the recording sheet P on the secondary transfer nip is secondarily transferred onto the recording sheet P collectively with the actions of the secondary transfer electric field and a nip pressure and is combined with white color of the recording sheet P so as to form a full-color toner image. The recording sheet P on which the full-color toner image has been formed on the surface passes through the secondary transfer nip, and then, is separated from the secondary transfer roller 36 and the intermediate transfer belt 31 in a curvature manner.

The secondary transfer opposing roller 33 includes a cored bar and a conductive NBR-based rubber layer coated on a surface of the core bar. Furthermore, the secondary transfer roller 36 also includes a cored bar and a conductive NBR-based rubber layer coated on a surface of the core bar. The secondary transfer power supply 39 as a transfer voltage application unit has a DC power supply and an AC power supply. The secondary transfer power supply 39 can apply an alternating voltage in which an AC voltage (AC component) is superimposed on a DC voltage (DC component) to the secondary transfer nip as the secondary transfer voltage.

Instead of the configuration in which the secondary transfer voltage composed of the alternating voltage is applied to the secondary transfer opposing roller 33 and the secondary transfer roller 36 is grounded, a configuration in which the secondary transfer voltage composed of the alternating voltage is applied to the secondary transfer roller 36 and the secondary transfer opposing roller 33 is grounded may be employed. In this case, polarity of the DC voltage is made different. To be more specific, when the secondary transfer voltage is applied to the secondary transfer opposing roller 33 under a condition that toner having negative polarity is used and the secondary transfer roller 36 is grounded as illustrated in FIG. 3, the DC voltage having the negative polarity same as the toner is used, so that the time average value of the secondary transfer voltage is set to be at the negative polarity same as the toner. In contrast, when the secondary transfer opposing roller 33 is grounded and the secondary transfer voltage is applied to the secondary transfer roller 36, the DC voltage having positive polarity opposite to the toner is used, so that the time average value of the secondary transfer voltage is set to be at the positive polarity opposite to the toner.

Furthermore, instead of the configuration in which the secondary transfer voltage composed of the alternating voltage is applied to any one of the secondary transfer opposing roller 33 and the secondary transfer roller 36, a configuration in which a DC voltage is applied to any one of the rollers and an AC voltage is applied to the other of them may be employed.

It is to be noted that when not a sheet with large surface irregularities such as coarse paper but a sheet with less surface irregularities such as plain paper is used as the recording sheet P, a shading pattern in accordance with the irregularity pattern does not appear. Therefore, in such a case, the transfer voltage composed of the DC voltage only may be applied. However, when the sheet with large surface irregularities such as the coarse paper is used, the secondary transfer voltage is required to be switched to the above-mentioned alternating voltage from the voltage composed of the DC voltage only.

Transfer residual toner that has not been transferred onto the recording sheet P adheres to the intermediate transfer belt 31 after having passed through the secondary transfer nip. The transfer residual toner is cleaned from a front surface of the intermediate transfer belt 31 by the belt cleaning device 37 that abuts against the front surface of the intermediate transfer belt 31 from the inner side of the loop. The cleaning backup roller 34 arranged at the inner side of the loop of the intermediate transfer belt 31 backs up the cleaning of the belt by the belt cleaning device 37.

The fixing device 90 is arranged at the right side of the secondary transfer nip in FIG. 3. The fixing device 90 forms a fixing nip by a fixing roller 91 incorporating a heat source such as a halogen lamp and a pressing roller 92 that rotates while abutting against the fixing roller 91 with a predetermined pressure. The recording sheet P fed into the fixing device 90 is nipped by the fixing nip in a posture in which an unfixed toner image carrying surface is made close contact with the fixing roller 91. Then, toner in the toner image is softened by influences of heat and pressure, so that a full-color image is fixed. The recording sheet P discharged from the fixing device 90 is discharged to the outside of the apparatus through a post-fixing conveying path.

In the printer, a process linear velocity (linear velocity of the photosensitive elements and the intermediate transfer belt) in a standard mode is approximately 280 mm/s. However, a process linear velocity in a high-image-quality mode for assigning priority to high image quality rather than printing speed is set to be a value lower than that in the standard mode. In addition, a process linear velocity in a high-speed mode for assigning priority to printing speed rather than image quality is set to be a value higher than that in the standard mode. The standard mode, the high-image-quality mode, and the high-speed mode are switched by operating keys on an operation panel by a user or a printer property menu on a personal computer.

When a monochrome image is formed, a supporting plate (not illustrated) that supports the primary transfer rollers 35Y, 35M, and 35C for Y, M, and C on the transfer unit 30 is moved so as to make the primary transfer rollers 35Y, 35M, and 35C be farther from the photosensitive elements 2Y, 2M, and 2C, respectively. Therefore, the front surface of the intermediate transfer belt 31 is separated from the photosensitive elements 2Y, 2M, and 2C and the intermediate transfer belt 31 is made to abut against the photosensitive element 2K for K only. In this state, only the image forming unit 1K for K among the four image forming units 1Y, 1M, 1C, and 1K is driven, so that the K toner image is formed on the photosensitive element 2K.

In the printer, the secondary transfer voltage is an alternating voltage in which a supply voltage having polarity (negative polarity) in the transfer direction in which a toner image on the intermediate transfer belt 31 is transferred onto the recording sheet P from the intermediate transfer belt 31 and a return voltage having polarity (positive polarity) opposite to the supply voltage are switched alternately when the toner image is secondarily transferred onto the recording sheet P. A time average value Vave of the secondary transfer voltage is set to be at the polarity (negative polarity) in the transfer direction in which the toner image is transferred onto the recording sheet P from the intermediate transfer belt 31. In the embodiment, if such a secondary transfer voltage is applied, when the polarity of the secondary transfer voltage is the negative polarity same as the toner (that is, the supply voltage is applied), the toner having the negative polarity is pressed out to the secondary transfer roller 36 from the secondary transfer opposing roller 33 electrostatically in the secondary transfer nip. With this, the toner on the intermediate transfer belt 31 is transferred onto the recording sheet P. On the other hand, when the polarity of the secondary transfer voltage is the positive polarity opposite to the toner (that is, the return voltage is applied), the toner having the negative polarity is attracted to the secondary transfer opposing roller 33 from the secondary transfer roller 36 electrostatically in the secondary transfer nip. With this, the toner transferred onto the recording sheet P is attracted to the intermediate transfer belt 31 again.

Next, observation experiments performed by the applicants are described.

The applicants have produced a special observation experimental device for observing behavior of the toner in the secondary transfer nip.

Figure 5:
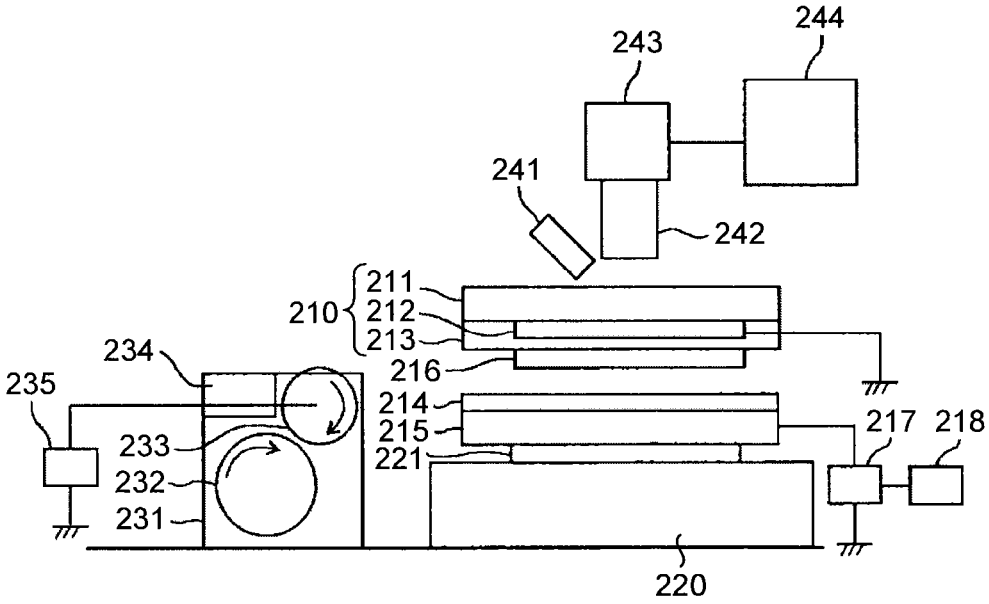
FIG. 5 is a schematic configuration view illustrating an observation experimental device used for experiments.

FIG. 5 is a schematic configuration view illustrating the observation experimental device.

The observation experimental device includes a transparent substrate 210, a developing device 231, a Z stage 220, an illumination 241, a microscope 242, a high-speed camera 243, and a personal computer 244, for example. The transparent substrate 210 includes a glass plate 211, a transparent electrode 212, and a transparent insulating layer 213. The transparent electrode 212 is formed on a lower surface of the glass plate 211 and is made of Indium Tin Oxide (ITO). The transparent insulating layer 213 is coated on the transparent electrode 212 and is made of a transparent material. The transparent substrate 210 is supported at a predetermined height position by a substrate supporting unit (not illustrated). The substrate supporting unit can be moved in the up, down, right, left directions in FIG. 5 by a movement mechanism (not illustrated). In the example as illustrated in FIG. 5, the transparent substrate 210 is located above the Z stage 220 on which a metal plate 215 is placed. However, the transparent substrate 210 can be also moved to a position just above the developing device 231 arranged next to the Z stage 220 with the movement of the substrate supporting unit. It is to be noted that the transparent electrode 212 of the transparent substrate 210 is connected to an electrode fixed to the substrate supporting unit and the electrode is grounded.

The developing device 231 has the same configuration as the developing device of the printer according to the embodiment. The developing device 231 includes a screw member 232, a developing roller 233, and a doctor blade 234, for example. The developing roller 233 is driven rotationally in a state where a developing bias is applied by a power supply 235.

If the transparent substrate 210 is moved to the position just above the developing device 231 and a position opposed to the developing roller 233 through a predetermined gap at a predetermined speed with the movement of the substrate supporting unit, toner on the developing roller 233 is transferred onto the transparent electrode 212 of the transparent substrate 210. With this, a toner layer 216 having a predetermined thickness is formed on the transparent electrode 212 of the transparent substrate 210. A toner adhesion amount per unit area on the toner layer 216 can be adjusted by toner density of a developer, a charged amount of the toner, a developing bias value, a gap between the substrate 210 and the developing roller 233, a movement speed of the transparent substrate 210, a rotating speed of the developing roller 233, and the like.

The transparent substrate 210 on which the toner layer 216 has been formed is moved in parallel to a position opposed to a recording sheet 214 bonded onto the flat metal plate 215 with a conductive adhesive. The metal plate 215 is disposed on a substrate 221 on which a weighing sensor is provided and the substrate 221 is disposed on the Z stage 220. Furthermore, the metal plate 215 is connected to a voltage amplifier 217. A transfer voltage composed of a DC voltage and an alternating voltage is input to the voltage amplifier 217 by a waveform generator 218. The transfer voltage amplified by the voltage amplifier 217 is applied to the metal plate 215. If the Z stage 220 is controlled to be driven so as to make the metal plate 215 move up, the recording sheet 214 is started to make contact with the toner layer 216. If the metal plate 215 is made to move up further, pressure to the toner layer 216 increases. The moving-up of the metal plate 215 is stopped such that an output from the weighing sensor is a predetermined value. In a state where a pressure is set to the predetermined value, the transfer voltage is applied to the metal plate 215 and behavior of the toner is observed. After the observation, the Z stage 220 is controlled to be driven so as to move down the metal plate 215 and separate the recording sheet 214 from the transparent substrate 210. With this, the toner layer 216 is transferred onto the recording sheet 214.

The behavior of the toner is observed by the microscope 242 and the high-speed camera 243 arranged above the substrate 210. All layers constituting the substrate 210 that includes the glass plate 211, the transparent electrode 212, and the transparent insulating layer 213 are made of transparent materials. Therefore, the behavior of the toner under the transparent substrate 210 can be observed from the upper side of the transparent electrode 212 through the transparent substrate 210.

As the microscope 242, a microscope formed by a zoom lens VH-Z75 manufactured by Keyence Corp. was used. Furthermore, as the high-speed camera 243, FASTCAM-MAX 120KC manufactured by Photron, Inc. was used. The FASTCAM-MAX 120KC manufactured by Photron, Inc. is controlled to be driven by the personal computer 244. The microscope 242 and the high-speed camera 243 are supported by a camera supporting unit (not illustrated). The camera supporting unit is configured to be capable of adjusting a focus of the microscope 242.

The behavior of the toner on the transparent substrate 210 was shot as follows. That is, first, illumination light was irradiated onto an observation position of the behavior of the toner by the illumination 241 and the focus of the microscope 242 was adjusted. Next, the transfer voltage was applied to the metal plate 215 so as to move the toner of the toner layer 216 adhered to the lower surface of the transparent substrate 210 toward the recording sheet 214. The behavior of the toner at this time was shot by the high-speed camera 243.

Figure 10:
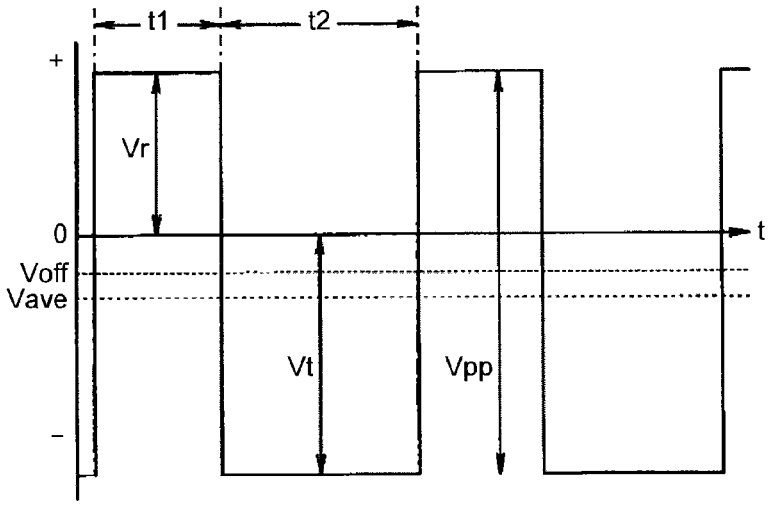
FIG. 10 is a waveform chart illustrating a voltage waveform of a secondary transfer voltage to be output from a secondary transfer power supply on the printer.

The observation experimental device as illustrated in FIG. 5 and the printer according to the embodiment are different in the configurations of the transfer nips for transferring the toner onto the recording sheet. Therefore, transfer electric fields acting on the toner are different from each other even when the transfer voltage is the same. In order to find an appropriate observation condition, the transfer voltage condition under which preferable reproducibility of density of the recesses was obtained was also examined in the observation experimental device. As the recording sheet 214, FC Japanese paper type "SAZANAMI" manufactured by NBS Ricoh Co., Ltd. was used. As the toner, a mixture of Y toner having an average grain diameter of 6.8 μm and a small amount of K toner was used. In the observation experimental device, the transfer voltage is applied to a rear surface of the recording sheet (SAZANAMI). Therefore, the polarity of the transfer voltage capable of transferring the toner onto the recording sheet is opposite to that of the printer according to the embodiment (that is, positive polarity). As the AC component of the transfer voltage as the secondary transfer voltage, an AC component having a waveform as illustrated in FIG. 10, which will be described later, was employed. The toner layer 216 was transferred onto the recording sheet 214 in an amount of adhered toner of 0.4 to 0.5 mg/cm2 while a frequency f of the AC component was set to 1000 Hz, a DC component (in the example, corresponding to the time average value Vave) was set to 200 V, and the peak-to-peak voltage Vpp was set to 1000V. As a result, a sufficient image density could be obtained on the recesses on the surface of "SAZANAMI".

In this case, the microscope 242 was focused on the toner layer 216 on the transparent substrate 210 and the behavior of the toner was shot. With this shooting, the following phenomenon was observed. That is, toner particles in the toner layer 216 reciprocated between the transparent substrate 210 and the recording sheet 214 by an alternating electric field formed by the transfer voltage. As the number of times of the reciprocating movement increased, an amount of reciprocating toner particles increased. To be more specific, in the transfer nip, for every one period (1/f) of the AC component of the transfer voltage, the alternating electric field acted once, so that the toner particles reciprocated once.

Figure 6:
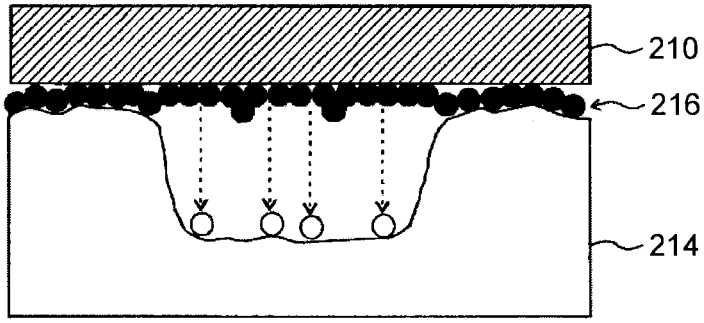
FIG. 6 is an enlarged plan view schematically illustrating behavior of toner at a transfer initial stage on the secondary transfer nip.
Figure 7:
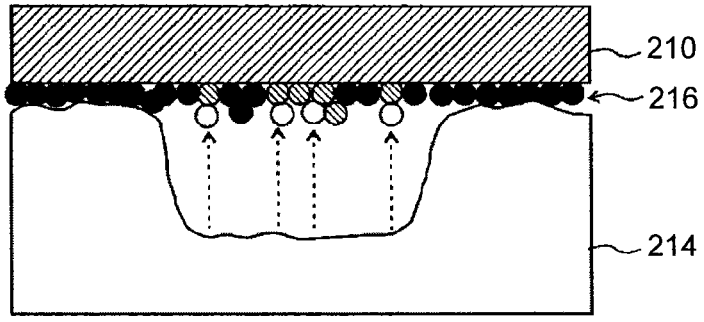
FIG. 7 is an enlarged plan view schematically illustrating behavior of the toner at a transfer middle stage on the secondary transfer nip.
Figure 8:
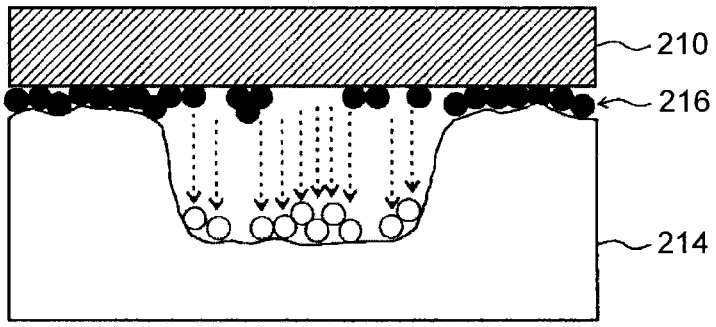
FIG. 8 is an enlarged plan view schematically illustrating behavior of the toner at a transfer late stage on the secondary transfer nip.

In a first period, as illustrated in FIG. 6, only toner particles present on the layer surface in the toner layer 216 escaped from the layer. Then, the toner particles entered the recesses on the recording sheet 214, and then, returned to the toner layer 216 again. In this case, the returned toner particles collided with other toner particles in the toner layer 216. With this, adhesion forces of the latter toner particles to the toner layer 216 and the transparent substrate 210 were made weak. Therefore, in the subsequent one period, as illustrated in FIG. 7, more toner particles than those in the previous one period escaped from the toner layer 216. Then, the toner particles entered the recesses on the recording sheet 214, and then, returned to the toner layer 216 again. In this case, the returned toner particles collided with toner particles still remaining in the toner layer 216. With this, adhesion forces of the latter toner particles to the toner layer 216 and the transparent substrate 210 were made weak. Therefore, in the further subsequent one period, as illustrated in FIG. 8, much more toner particles than those in the previous one period escaped from the toner layer 216. In this manner, every time toner particles reciprocated, the number of toner particles gradually increased. This revealed a fact that a sufficient amount of toner had been transferred onto the recesses on the recording sheet 214 when the nip passage time had elapsed (when a time corresponding to a nip passage time had elapsed in the observation experimental device).

In this case, the time average value Vave of the transfer voltage was set to −200 V and the return voltage Vr was set to +300 V. Therefore, the absolute value of the peak value Vr of the above-mentioned return voltage was set to be larger than the absolute value of the time average value Vave. In other words, a condition of $|Vr|>|Vave|$ was satisfied.

Next, under a condition that the DC voltage (corresponding to the time average value Vave in this example) was set to 200 V and the peak-to-peak voltage Vpp was set to 800 V, the behavior of the toner was shot. With this shooting, the following phenomenon was observed. That is, among the toner particles in the toner layer 216, toner particles present on the layer surface escaped from the layer and entered the recesses on the recording sheet 214 in a first one period. However, after that, the entered toner particles remained in the recesses without moving toward the toner layer 216. When the subsequent one period came, toner particles that escaped from the toner layer 216 newly and entered the recesses on the recording sheet 214 were extremely few. Therefore, at a time point when the nip passage time had elapsed, only a small amount of toner particles had been transferred onto the recesses on the recording sheet P.

In this case, the time average value Vave of the transfer voltage was set to −200 V and the return voltage Vr was set to +200 V. Therefore, the absolute value of the peak value Vr of the above-mentioned return voltage was identical to the absolute value of the time average value Vave and the condition of $|Vr|>|Vave|$ was not satisfied.

Next, a characteristic configuration of the printer is described.

Figure 9:
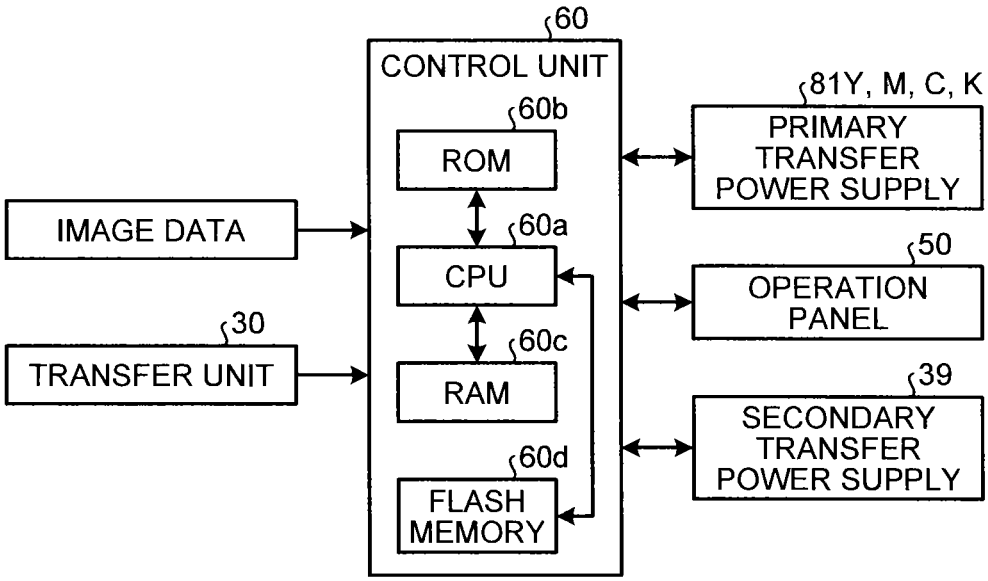
FIG. 9 is a block diagram illustrating a part of an electric circuit of the printer.

FIG. 9 is a block diagram illustrating a part of an electric circuit of the printer.

In FIG. 9, a control unit 60 constituting a part of the transfer voltage application unit includes a central processing unit (CPU) 60*a* as an operating unit, a random access memory (RAM) 60*c* as a non-volatile memory, a read only memory (ROM) 60*b* as a temporary storing unit, and a flash memory 60*d*, for example. Various devices and sensors are connected to the control unit 60 for controlling the apparatus overall. However, only the devices and the sensors relating to the characteristic configuration of the printer are illustrated.

Primary transfer power supplies 81Y, 81M, 81C, and 81K are power supplies that output primary transfer voltages to be applied to the primary transfer rollers 35Y, 35M, 35C, and 35K, respectively. Furthermore, the secondary transfer power supply 39 is a power supply that applies the secondary transfer voltage to the secondary transfer nip through the secondary transfer opposing roller 33, and configures the transfer voltage application unit together with the control unit 60. An operation panel 50 is constituted by a touch panel, a plurality of keyboard buttons, and the like (any of them are not illustrated). The operation panel 50 displays an image on a screen of the touch panel and receives an input operation with the touch panel and the keyboard buttons by an operator. Furthermore, the operation panel 50 can display an image on the touch panel based on a control signal transmitted from the control unit 60.

FIG. 10 is a waveform chart illustrating a voltage waveform of the secondary transfer voltage to be output from the secondary transfer power supply 39 in the embodiment.

The secondary transfer voltage in the embodiment is configured to have a rectangular wave as illustrated in FIG. 10. A time average value Vave thereof is set to be closer to a peak value Vt of a supply voltage relative to an offset voltage Voff as a center value between a maximum value (that is, a peak value Vr of a return voltage) and a minimum value (that is, the peak value Vt of the supply voltage) of the secondary transfer voltage. Here, the offset voltage Voff is a value defined by $Voff=(Vt+Vr)/2$. In a supply voltage application period t2 of the secondary transfer voltage, an electric field acting in the transfer direction in which the toner charged to normal polarity (in the example, negative polarity) is moved to the recording sheet P from the intermediate transfer belt 31 is formed in the secondary transfer nip. In contrast, in a return voltage application period t1 of the secondary transfer voltage, an electric field acting in the direction in which the toner charged to the negative polarity is returned to the intermediate transfer belt 31 from the recording sheet P is formed in the secondary transfer nip. As the AC component of the secondary transfer voltage as illustrated in FIG. 10, an AC component having a rectangular waveform of which duty ratio is set such that the return voltage application period t1 is shorter than the supply voltage application period t2 is employed. With this, the time average value Vave of the secondary transfer voltage is set to be closer to the peak value Vt of the supply voltage relative to the offset voltage Voff.

The waveform of the secondary transfer voltage may not be the rectangular waveform as illustrated in FIG. 10. The waveform of the secondary transfer voltage may be a triangular waveform or a trapezoidal waveform as long as the waveform is an asymmetric waveform such that the time average value Vave of the secondary transfer voltage is set to be closer to the peak value Vt of the supply voltage relative to the offset voltage Voff. In particular, when the secondary transfer voltage is the rectangular wave as illustrated in FIG. 10, the secondary transfer voltage reaches a peak value at the positive polarity side at a time when the voltage has risen to the positive polarity side and reaches a peak value at the negative polarity side at a time when the voltage has risen to the negative polarity side. It has been found from the experiments performed by the applicants that a large current flows instantaneously and electric discharge that generates white spots is easily generated at this time with such a waveform. Therefore, a waveform (waveform obtained by deforming a sine wave, triangular wave, trapezoidal wave, or the like) with which large current is difficult to flow instantaneously to the extent possible is used preferably.

Furthermore, in the printer, the time average value Vave of the secondary transfer voltage is required to be set to be closer to the peak value Vt of the supply voltage relative to the offset voltage Voff. In the embodiment, in order to obtain such an asymmetric waveform, a duty ratio of a symmetric rectangular wave is changed so as to make the application period t2 of the supply voltage longer than the application period t1 of the return voltage. Such an asymmetric waveform can be obtained even when both the periods t1 and t2 are set to be the same. However, if both the periods t1 and t2 are adjusted such that the application period t2 of the supply voltage is longer than the application period t1 of the return voltage, the peak value Vt of the supply voltage can be set to be lower in comparison with a case where the periods t1 and t2 are set to be the same.

In the embodiment, when generation of shading in accordance with surface irregularities is suppressed by using the secondary transfer voltage composed of the alternating voltage when an image is formed on the recording sheet P with large surface irregularities, the time average value Vave thereof is set to be large so as to ensure a sufficient image density on the protrusions on the recording sheet P, and the absolute value of the peak value Vt of the return voltage is set to be a sufficiently large value that is larger than the absolute value of the time average value Vave so as to also ensure a sufficient image density on the recesses on the recording sheet P.

In addition, the time average value Vave of the secondary transfer voltage is set to be closer to the peak value Vt of the supply voltage relative to the offset voltage Voff. Therefore, even if the time average value Vave is set to be large in order to ensure the sufficient image density on the protrusions on the recording sheet P and the absolute value of the peak value Vt of the return voltage is set to be large in accordance therewith, the absolute value of the peak value Vt of the return voltage is not required to be set excessively large. As a result, a large voltage that is equal to or larger than a discharge start voltage can be prevented from being applied into the secondary transfer nip in the application period t2 of the supply voltage. Therefore, generation of white spots (white out) in an image due to generation of electric discharge in the secondary transfer nip can be suppressed.

As a result, according to the embodiment, when an image is formed on the recording sheet P with large surface irregularities, a high-quality image at high density in which shading in accordance with the irregularities is suppressed and generation of white spots (white out) is also suppressed can be formed.

Next, experiments performed by the applicants are described.

First Experiment

The applicants prepared a print test apparatus having the same configuration as the printer according to the above-mentioned embodiment. Then, the applicants performed various types of print tests by using the print test apparatus. A process linear velocity as a linear velocity of the photosensitive elements and the intermediate transfer belt 31 was set to 173 mm/s. Furthermore, the frequency f of the AC component of the secondary transfer voltage was set to 1000 Hz. In addition, as the recording sheet P, duodecimo paper of "Leathac 66" (trade name) manufactured by TOKUSHU PAPER MFG. CO., LTD. having a ream weight of 175 kg was used. The "Leathac 66" is paper having a larger degree of surface irregularities than the above-mentioned "SAZANAMI". The depth of the recesses on the paper surface is approximately 100 μm at maximum. A blue solid image obtained by superimposing a solid image of M color and a solid image of C color was output to the Leathac 66 under various secondary transfer voltage conditions. Then, each of image density (ID) of the M component and image density (ID) of the C component of the output blue solid image was measured by X-Rite938 manufactured by X-Rite. It is to be noted that temperature and humidity conditions in the first experiment were 27° C. and 80%. Then, the sum of these two image densities was obtained as image density of blue. Blue is recognized to be sufficient coloration by almost all observers if the image density (ID) thereof is equal to or higher than 2.7. Therefore, a target value of the image density (ID) of blue was set to equal to or higher than 2.7. It was found that a condition of the secondary transfer voltage under which the image density of blue could be made to be equal to or higher than 2.7 was relatively limited.

In the first experiment, a value of the DC component of the secondary transfer voltage was adjusted such that the image quality of blue was the target density (equal to or higher than 2.7) for seven conditions that a ratio (hereinafter, referred to as "return time ratio") of the application period t1 of the return voltage in one cycle in the AC component of the secondary transfer voltage was set to 8%, 12%, 16%, 32%, 40%, 45%, and 50%. As a result, it was found that the value of the DC component with which the image density of blue could be set to the target density (equal to or higher than 2.7) was different to a large extent among these seven conditions.

Second Experiment

Next, a second experiment performed while taking the result of the above-mentioned first experiment into consideration is described.

Under the seven conditions that the return time ratio is 8%, 12%, 16%, 32%, 40%, 45%, and 50%, the time average value Vave of the secondary transfer voltage was changed finely in a range to 1 kV based on the time average value Vave when the DC component with which the highest image density (ID of blue) was obtained in the test print in the above-mentioned first experiment was used. Then, a blue solid image was output under each condition. Temperature and humidity conditions in the second experiment were also 27° C. and 80%. Furthermore, in the same manner as the above-mentioned first experiment, the image density (ID) of blue for each blue solid image was measured. In this measurement, an image density on the protrusions and an image density on the recesses on the paper surface were measured.

In the second experiment, the image density on the protrusions and the image density on the recesses on the paper surface of the blue solid image were evaluated in the following manner. A rank 5 is ideal but a rank of equal to or higher than 3.5 is allowable.

Rank 5: The protrusions and the recesses are completely even blue.

Rank 4.5: The protrusions and the recesses are substantially even blue but deeper portions of the recesses are slightly paler blue than the protrusions.

Rank 4: The protrusions and the recesses are substantially even blue but there are deeper portions of the recesses and a part of the protrusions that are slightly pale blue.

Rank 3.5: There are more portions of the protrusions and the recesses parts of which are slightly pale blue than Rank 4 but the overall paper surface is substantially even blue. Allowable limit level.

Rank 3: The ground of the paper is recognized on the deeper portions of the recesses obviously.

Rank 2: Worse than Rank 3 and better than Rank 1, which will be described later.

Rank 1: Toner does not adhere to the recesses at all.

As a result of the second experiment, under the conditions of the respective return time ratios, secondary transfer conditions and evaluation ranks when the evaluation ranks were the best are indicated in Table 1. It is to be noted that in Table 1, "1C Rank" indicates an evaluation rank for single-color toner and "2C Rank" indicates an evaluation rank for two-color-superimposed toner.

TABLE 1

| | Return time ratio | | | | | | |
|---|---|---|---|---|---|---|---|
| | 8% | 12% | 16% | 32% | 40% | 45% | 50% |
| Vpp kV | 12 | 12 | 10 | 10 | 10 | 10 | 8 |
| Vave kV | −2.8 | −2.8 | −2.6 | −2.2 | −1.8 | −1.6 | −1.4 |
| \|Vave\| kV | 2.8 | 2.8 | 2.8 | 2.2 | 1.8 | 1.6 | 1.4 |
| Vr kV | 8.24 | 7.76 | 5.8 | 4.6 | 4.2 | 3.9 | 2.6 |
| Vt kV | −3.76 | −4.24 | −4.2 | −5.4 | −5.8 | −6.1 | −5.4 |
| \|Vt\| kV | 3.76 | 4.24 | 4.2 | 5.4 | 5.8 | 6.1 | 5.4 |
| 1C Rank | 3.5 | 4.5 | 3.5 | 3.5 | 3.5 | 3.5 | 3.5 |
| 2C Rank | 3.5 | 4.5 | 4 | 3.5 | 3.5 | 3.5 | 3.5 |

In the result as indicated in Table 1, conditions of the secondary transfer voltage under which blue image densities on both the protrusions and the recesses can be made to be equal to or higher than 2.7 satisfy |Vr|>|Vave| in all the cases.

Figure 11A:
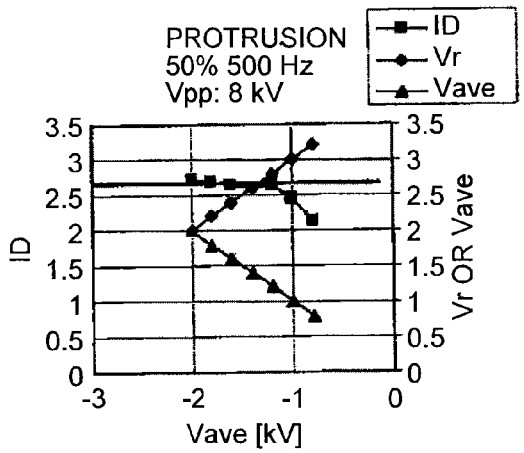
FIG. 11A is a graph illustrating a result obtained by evaluating an image density (ID) on protrusions when a time average value Vave of a secondary transfer voltage is changed by using the secondary transfer voltage of which return time ratio is 50%, frequency is 500 Hz, and peak-to-peak voltage Vpp is 8 kV in a ranked manner.

FIG. 11A is a graph illustrating a result of rank evaluation of the image density (ID) of the protrusions when the time average value Vave of the secondary transfer voltage was changed by using the secondary transfer voltage of which return time ratio was 50%, frequency was 500 Hz, and peak-to-peak voltage Vpp was 8 kV.

Figure 11B:
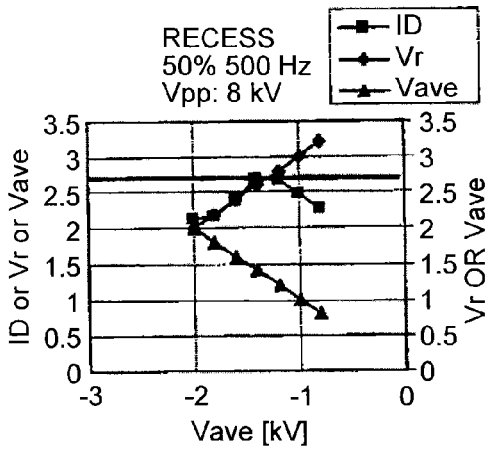
FIG. 11B is a graph illustrating a result obtained by evaluating the image density (ID) on recesses in FIG. 11A in a ranked manner.

FIG. 11B is a graph indicating a result of rank evaluation of the image density (ID) of the recesses in FIG. 11A.

In each graph, the absolute value of the peak value Vr of the return voltage is also illustrated.

On the protrusions, on focusing on a relation between the absolute value of the time average value Vave and the image density (ID), as illustrated in FIG. 11A, if the time average value Vave is equal to or larger than approximately −1 kV (when the absolute value of the time average value Vave is equal to or smaller than approximately 1 kV), the image density (ID) does not reach the target density (2.7) and the image density is insufficient. However, if the absolute value of the time average value Vave is equal to or larger than approximately 1.2 kV, sufficient transfer performance is obtained and the image density (ID) reaches the target density (2.7). As a result, the following fact is found. That is, on the protrusions, if the absolute value of the time average value Vave is equal to or smaller than approximately 1 kV, the absolute value is too small and the sufficient transfer performance is not obtained. Furthermore, on the protrusions, if the absolute value of the time average value Vave is equal to or larger than approximately 1.2 kV, sufficient transfer performance is obtained.

On the other hand, on the recesses, as illustrated in FIG. 11B, if the absolute value of the time average value Vave is equal to or smaller than approximately 1 kV, the image density (ID) does not reach the target density (2.7) and the image density is insufficient as in the case of the protrusions. If the absolute value of the time average value Vave is equal to or smaller than approximately 1 kV, as illustrated in FIG. 11A, the image density is insufficient even on the protrusions on which preferable transfer performance is easier to be obtained than the recesses. Therefore, the absolute value of the time average value Vave is also too small and the sufficient transfer performance is not also obtained on the recesses as in the case of the protrusions.

Furthermore, on the recesses, as illustrated in FIG. 11B, if the absolute value of the time average value Vave is approximately 1.2 kV, the image density (ID) reaches the target density (2.7). However, on the recesses, if the absolute value of the time average value Vave is equal to or larger than approximately 1.4 kV, the image density (ID) becomes lower than the target density (2.7) again. Then, as the absolute value of the time average value Vave increases, the image density (ID) tends to decrease. In this manner, even when the absolute value of the time average value Vave is set to be a sufficiently large value with which sufficient transfer performance is obtained on the protrusions, the sufficient transfer performance is not obtained and image density is insufficient in some cases on the recesses.

In FIG. 11B, on focusing on a relation between the peak value Vr of the return voltage and the image density ID, when the absolute value of the time average value Vave is set to be a sufficiently large value with which sufficient transfer performance is obtained on the protrusions (that is, when the absolute value of the time average value Vave is equal to or larger than approximately 1.4 kV), as the peak value Vr of the return voltage increases, the image density (ID) tends to increase.

Figure 12A:
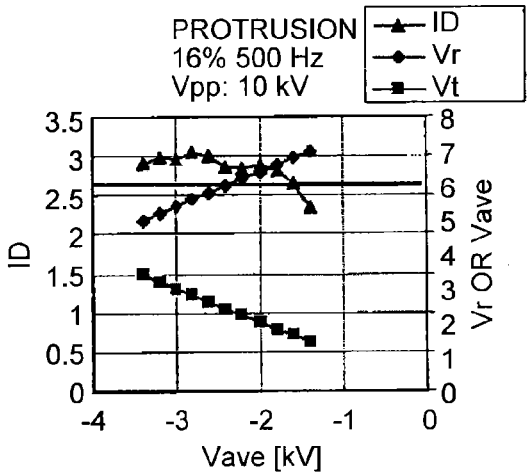
FIG. 12A is a graph illustrating a result obtained by evaluating the image density (ID) on the protrusions when a time average value Vave of a secondary transfer voltage is changed by using the secondary transfer voltage of which return time ratio is 16%, frequency is 500 Hz, and peak-to-peak voltage Vpp is 10 kV in a ranked manner.

FIG. 12A is a graph illustrating a result of rank evaluation of the image density (ID) of the protrusions when the time average value Vave of the secondary transfer voltage is changed by using the secondary transfer voltage of which return time ratio is 16%, frequency is 500 Hz, and peak-to-peak voltage Vpp is 10 kV.

Figure 12B:
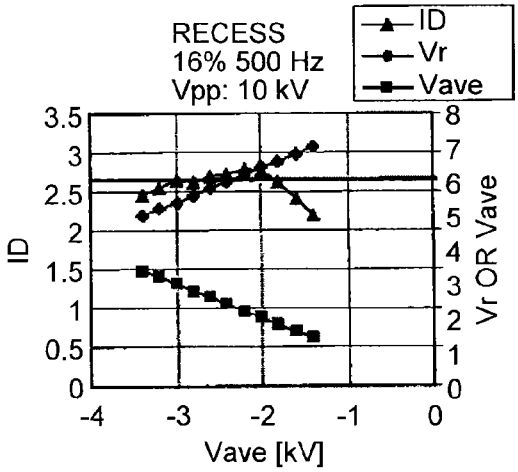
FIG. 12B is a graph illustrating a result obtained by evaluating the image density (ID) on the recesses in FIG. 12A in a ranked manner.

FIG. 12B is a graph indicating a result of rank evaluation of the image density (ID) of the recesses in FIG. 12A.

In each graph, the absolute value of the peak value Vr of the return voltage is also illustrated.

On the protrusions, as illustrated in FIG. 12A, if the absolute value of the time average value Vave is equal to or smaller than approximately −1.7 kV, the image density (ID) does not reach the target density (2.7) and the image density is insufficient. However, if the absolute value of the time average value Vave is equal to or larger than approximately 1.8 kV, sufficient transfer performance is obtained and the image density (ID) reaches the target density (2.7).

Also on the recesses, as illustrated in FIG. 12B, if the absolute value of the time average value Vave is equal to or smaller than approximately 1.7 kV, the image density (ID) does not reach the target density (2.7) and the image density is insufficient as in the cases of the protrusions. Furthermore, on focusing on a range in which the absolute value of the time average value Vave is equal to or larger than approximately 2.2 kV, as the absolute value of the time average value Vave increases, the image density (ID) tends to decrease. On the other hand, on focusing on a relation between the peak value Vr of the return voltage and the image density (ID) in this range, as illustrated in FIG. 12B, as the peak value Vr of the return voltage increases, the image density (ID) tends to increase. That is to say, also in the example as illustrated in FIGS. 12A and 12B, when the absolute value of the time average value Vave is set to be a sufficiently large value with which sufficient transfer performance is obtained on the protrusions, as the peak value Vr of the return voltage increases, the image density (ID) tends to increase.

Figure 13A:
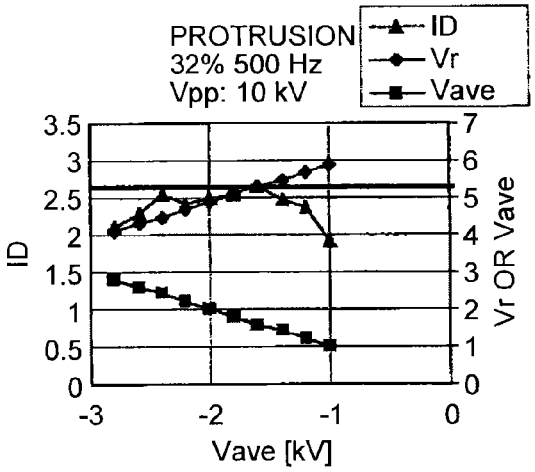
FIG. 13A is a graph illustrating a result obtained by evaluating the image density (ID) on the protrusions when a time average value Vave of a secondary transfer voltage is changed by using the secondary transfer voltage of which return time ratio is 32%, frequency is 500 Hz, and peak-to-peak voltage Vpp is 10 kV in a ranked manner.

FIG. 13A is a graph illustrating a result of rank evaluation of the image density (ID) of the protrusions when the time average value Vave of the secondary transfer voltage is changed by using the secondary transfer voltage of which return time ratio is 32%, frequency is 500 Hz, and peak-to-peak voltage Vpp is 10 kV.

Figure 13B:
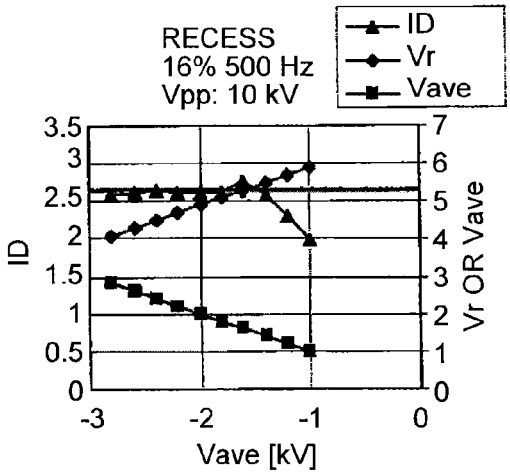
FIG. 13B is a graph illustrating a result obtained by evaluating the image density (ID) on the recesses in FIG. 13A in a ranked manner.

FIG. 13B is a graph indicating a result of rank evaluation of the image density (ID) of the recesses in FIG. 13A.

In the example as illustrated in FIGS. 13A and 13B, substantially the same tendency as that in FIGS. 12A and 12B can be observed.

In addition, when the example in which the return time ratio is 50% as illustrated in FIGS. 11A and 11B and the examples in which the return time ratio is 16% and 32% as illustrated in FIGS. 12A and 12B and FIGS. 13A and 13B are compared with each other, a range of the time average Vave in which both the image density on the recesses and the image density of the protrusions are equal to or higher than the target density (2.7) is enlarged as the return time ratio is lowered. The same experiment was performed under the condition that the return time ratio was 8%. The range of the time average Vave in which both the image density on the recesses and the image density of the protrusions were equal to or higher than the target density (2.7) was further enlarged. However, if the return time ratio is 6%, the toner having entered in the recesses on the sheet surface cannot be returned to the intermediate transfer belt preferably. Therefore, in this case, a sufficient image density could not be obtained on the recesses.

From the above-descried results, in the printer according to the embodiment, it is preferable that the secondary transfer voltage of which return time ratio is set in a range of at least equal to or higher than 8% and equal to or lower than 50% be used.

Table 2 is a table indicating an experimental result when the same experiment was performed while the temperature and humidity conditions were changed to 23° C. and 50%. Note that the conditions of the return time ratio used in the experiment were seven of 4%, 8%, 12%, 16%, 20%, 32%, and 50%.

TABLE 2

| | Return time ratio | | | | | | |
|---|---|---|---|---|---|---|---|
| | 4% | 8% | 12% | 16% | 20% | 32% | 50% |
| Vpp kV | 12 | 12 | 12 | 12 | 10 | 8 | 8 |
| Vave kV | −3 | −3 | −3 | −2.6 | −1.8 | −1.4 | −1 |
| \|Vave\| kV | 3 | 3 | 3 | 2.6 | 1.8 | 1.4 | 1 |
| Vr kV | 8.52 | 8.04 | 7.56 | 7.48 | 6.2 | 4.04 | 3 |
| Vt kV | −3.48 | −3.96 | −4.44 | −4.52 | −3.8 | −3.96 | −5 |
| \|Vt\| kV | 3.48 | 3.96 | 4.44 | 4.52 | 3.8 | 3.96 | 5 |
| 1C Rank | 3 | 4.5 | 4.5 | 4.5 | 4 | 4 | 4 |
| 2C Rank | 3 | 4.5 | 4.5 | 4.5 | 4 | 4 | 3.5 |

As indicated in Table 2, conditions of the secondary transfer voltage under which the blue image densities on both the protrusions and the recesses can be made to equal to or higher than the target rank 3.5 also satisfy |Vr|>|Vave| under the temperature and humidity conditions of 23° and 50%.

Table 3 is a table indicating an experimental result when the same experiment was performed while the temperature and humidity conditions were changed to 10° C. and 15%. Note that the conditions of the return time ratio used in the experiment were six of 4%, 8%, 12%, 16%, 20%, 32%, and 50%.

TABLE 3

| | Return time ratio | | | | | |
|---|---|---|---|---|---|---|
| | 8% | 12% | 16% | 24% | 32% | 50% |
| Vpp kV | 16 | 16 | 16 | 14 | 14 | 12 |
| Vave kV | −6.8 | −6.8 | −6.6 | −5.2 | −5.2 | −4.4 |
| \|Vave\| kV | 6.8 | 6.8 | 6.6 | 5.2 | 5.2 | 4.4 |
| Vr kV | 7.92 | 7.28 | 6.84 | 5.44 | 4.32 | 1.6 |
| Vt kV | −8.08 | −8.72 | −9.16 | −9.68 | −9.68 | −5.42 |
| \|Vt\| kV | 8.08 | 8.72 | 9.16 | 9.68 | 9.68 | 5.42 |
| 1C Rank | 4.5 | 4.5 | 4 | 3.5 | 3 | 2 |
| 2C Rank | 4.5 | 4.5 | 4 | 3.5 | 3 | 3 |

As indicated in Table 3, conditions of the secondary transfer voltage under which the blue image densities on both the protrusions and the recesses can be made to equal to or higher than the target rank 3.5 are conditions that the return time ratio is 8%, 12%, 16%, and 24% and |Vr|>|Vave| is satisfied under these conditions. Under the conditions that the return time ratio is 32%, and 50%, the rank is equal to or lower than 3 and desired image quality cannot be obtained. A relation between the absolute value of the peak value Vr of the return voltage and the absolute value of the time average value Vave in these cases satisfies |vr|≤|Vave|.

Third Experiment

The applicants performed an experiment for examining a minimum value of the return voltage application period t1 in which toner having entered in the recesses on the paper surface can be returned onto the intermediate transfer belt effectively in the secondary transfer nip. To be more specific, under a condition that the return time ratio was 50%, the frequency f of the AC component of the secondary transfer voltage, the time average value Vave, and the peak-to-peak voltage Vpp were changed appropriately, and the image density (ID) on the recesses of the blue solid image under each condition was measured. A relation between a value of a maximum image density IDmax and the frequency f of the AC component that were obtained in the experiment is illustrated in FIG. 14.

Figure 14:
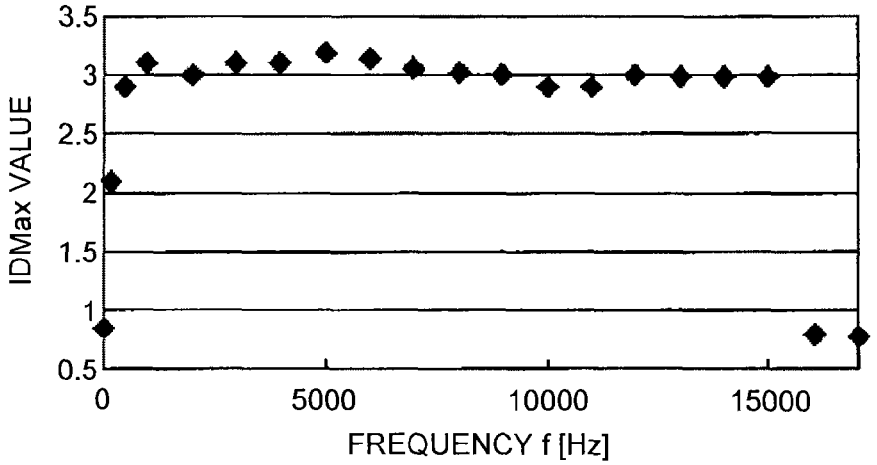
FIG. 14 is a graph illustrating a relation between a frequency f of an AC component of a secondary transfer voltage and a maximum image density IDmax when the secondary transfer voltage of which return time ratio is 50% is used.

If the frequency f is higher than approximately 15000 Hz, as illustrated in FIG. 14, the maximum image density IDmax becomes a value that is much lower than 2.7 as the target image density (ID). It can be considered because the return time is too short, so that reciprocating movement of the toner is not performed. The return voltage application period t1 in this case is 0.033 ms (=1/15000 Hz×50%). Therefore, the return voltage application period t1 is required to be at least equal to or longer than 0.03 ms.

Fourth Experiment

Under a condition that the peak-to-peak voltage Vpp of the AC component of the secondary transfer voltage was 2500 V, the offset voltage Voff was −800 V, and the return time ratio was 20%, a blue solid image was output to plain paper under each condition while changing the frequency f of the AC component and the process linear velocity v. The output solid image was observed visually. Furthermore, presence/absence of image density unevenness (pitch unevenness) that was considered to be generated by influence of the alternating electric field in the secondary transfer nip was evaluated. Then, it was found that under the condition of the same frequency f, as the process linear velocity v increased, the pitch unevenness was easily generated. Furthermore, it was found that under the condition of the same process linear velocity v, as the frequency f was lowered, the pitch unevenness was easily generated. The result of the experiment reveals that the pitch unevenness by the influence of the alternating electric field generated by the secondary transfer voltage as the alternating voltage is generated unless toner is made to reciprocate between the intermediate transfer belt and the paper surface by equal to or more than times to some extent (hereinafter, referred to as "in-nip reciprocating times") in the secondary transfer nip.

As described in detail, under a condition that the process linear velocity v was 282 mm/s and the frequency f was 400 Hz, the pitch unevenness was not recognized. However, under a condition that the process linear velocity v was 282 mm/s and the frequency f was 300 Hz, the pitch unevenness was recognized. In the embodiment, a secondary transfer nip width d as a length of the secondary transfer nip in the intermediate transfer belt movement direction is 3 mm. Therefore, the in-nip reciprocating times under the condition was calculated to be approximately four times (=3 mm×400 Hz/282 mm/s). If the in-nip reciprocating times is equal to or more than four times, the pitch unevenness can be avoided barely.

Alternatively, under a condition that the process linear velocity v was 141 mm/s and the frequency f was 200 Hz, the pitch unevenness was not recognized. However, under a condition that the process linear velocity v was 141 mm/s and the frequency f was 100 Hz, the pitch unevenness was recognized. Under the condition that the process linear velocity v was 141 mm/s and the frequency f was 200 Hz, the in-nip reciprocating times is also calculated to be approximately four times (=3 mm×200 Hz/141 mm/s) as in the case of the condition that the process linear velocity v was 282 mm/s and the frequency f was 400 Hz.

As described above, by satisfying the condition of "frequency f>(4/secondary transfer nip width d)×process linear velocity v", even if the alternating voltage is employed as the secondary transfer voltage, an image on which pitch unevenness by the influence of the alternating electric field in the secondary transfer nip is not generated can be obtained.

It is to be noted that the printer includes the operation panel 50 as an information acquiring unit and a communication unit that acquires printer driver setting information transmitted from the outside through communication in order to satisfy the condition. The printer grasps whether the printing operation is performed in any of the high-speed mode, the standard mode, and the low-speed mode based on information acquired by the above-mentioned constituent components. Furthermore, the printer grasps the process linear velocity v based on the grasped result.

Fifth Experiment

In the secondary transfer nip, the toner cannot be transferred preferably unless a transfer current to some extent flows to the recording sheet P. Furthermore, it is needless to say that the transfer current is difficult to flow to thick paper in comparison with paper having a normal thickness. It is desirable that toner is made to adhere to the protrusions and the recesses on the paper surface preferably on Japanese paper having a normal thickness and Japanese paper having a large thickness. The fifth experiment was performed in order to examine an advantageous method of controlling the secondary transfer voltage to realize that.

In the fifth experiment, the secondary transfer power supply 39 that outputs both the peak-to-peak voltage Vpp of the AC component and the DC component under constant voltage control was used. Other various conditions were as follows.

Process linear velocity: v=282 mm/s

Recording sheet: paper of Leathac 66 having a weight of 175 kg.

Test image: black solid image having a size of A4

Return time ratio=40%

DC component: 800 to 1800 V

Peak-to-peak voltage Vpp of AC component: 3 to 8 kV

Frequency of AC component: f=500 Hz

The image density on the recesses on the paper surface of the black solid image output under the above-mentioned conditions was evaluated as follows.

Rank 5: The recesses are filled with toner completely.

Rank 4: The recesses are filled with toner substantially but the ground of the paper is recognized slightly on deeper portions of the recesses.

Rank 3: The ground of the paper is recognized on the portions of the deeper recesses obviously.

Rank 2: Worse than Rank 3 and better than Rank 1, which will be described later.

Rank 1: The toner does not adhere to the recesses at all.

Furthermore, the image density on the protrusions on the paper surface of the black solid image was evaluated as follows.

Rank 5: Density unevenness does not appear at all and preferable image density is obtained.

Rank 4: Slight density unevenness appears but desired image density is obtained even on pale portions.

Rank 3: Density unevenness appears and image density on the pale portions is out of an allowable level and is insufficient.

Rank 2: Worse than Rank 2 and better than Rank 1, which will be described later.

Rank 1: Image density is insufficient overall.

Then, the evaluation result of the image density on the recesses and the evaluation result of the image density on the protrusions were combined as follows.

Rank A: Any of the evaluation results of the image densities on the recesses and the protrusions are equal to or higher than Rank 5.

Rank B: Any of the evaluation results of the image densities on the recesses and the protrusions are equal to or higher than Rank 4.

Rank C: Only the evaluation result of the image density on the recesses is equal to or lower than Rank 3.

Rank D: Only the evaluation result of the image density on the protrusions is equal to or lower than Rank 3.

Rank E: Any of the evaluation results of the image densities on the recesses and the protrusions are equal to or lower than Rank 3.

Furthermore, the same experiment was performed while as the recording sheet P, thicker paper of Leathac 66 having a weight of 215 kg is used instead of the paper of Leathac 66 having a weight of 175 kg. Then, as a combination of the DC component and the peak-to-peak voltage Vpp of the AC component, combinations with which results of Rank A (any of the evaluation results of the image densities on the recesses and the protrusions were equal to or higher than Rank 5) were obtained and results of Rank B (any of the evaluation results of the image densities on the recesses and the protrusions were equal to or higher than Rank 4) were obtained on both the paper of Leathac 66 having the weight of 175 kg and the paper of Leathac 66 having the weight of 215 kg were extracted among all the combinations applied to the experiments. As a result, a combination with which the results of Rank A were obtained on the both of paper was not present. However, the results of Rank B were obtained on the both of paper with a combination in which the peak-to-peak voltage Vpp of the AC component was 6 kV and the value of the DC component was −1100±100 V (center value±9%).

Sixth Experiment

In the sixth experiment, the secondary transfer power supply 39 that outputs the DC component of the secondary transfer voltage under constant current control was used. The target value (offset current Ioff) of the output was set to −30 to −60 μA. The experiment was performed while other conditions were set to the same conditions as those in the fifth experiment. As a result, Rank A at which any of the evaluation results of the image densities on the recesses and the protrusions were equal to or higher than Rank 5 was obtained with a combination in which the peak-to-peak voltage Vpp was 7 kV and the offset current Ioff was −42.5±7.5 μA (center value±18%). Furthermore, a combination with which results of Rank B were obtained on the both of paper was a combination in which the peak-to-peak voltage Vpp was 7 kV and the offset current Ioff was −47.5±12.5 μA (center value±26%).

As described above, in the fifth experiment, a combination with which results of Rank A were obtained on the both of paper was not present. However, in the sixth experiment, a combination with which results of Rank A were obtained on the both of paper was present. In addition, on focusing on the combination with which results of Rank B were obtained, the DC component was −1100±100 V (center value±9%) in the fifth experiment while the offset current Ioff was −47.5±12.5 μA (center value±26%) in the sixth experiment. A numerical value range from the center value is wider obviously in the sixth experiment. These experimental results indicate that when the DC component is output under the constant current control, margin of setting of a control target value that can respond to thick paper as well as paper having a normal thickness can be made larger in comparison with a case where the DC component is output under the constant voltage control.

Therefore, in the printer according to the embodiment, the secondary transfer power supply 39 that outputs the DC component under the constant current control is used preferably. It is to be noted that the secondary transfer power supply 39 may output the peak-to-peak voltage of the AC component under the constant current control. With this, an effective return peak current and an effective supply peak current can be generated reliably by making the peak-to-peak current constant regardless of environmental fluctuation.

Figure 15:
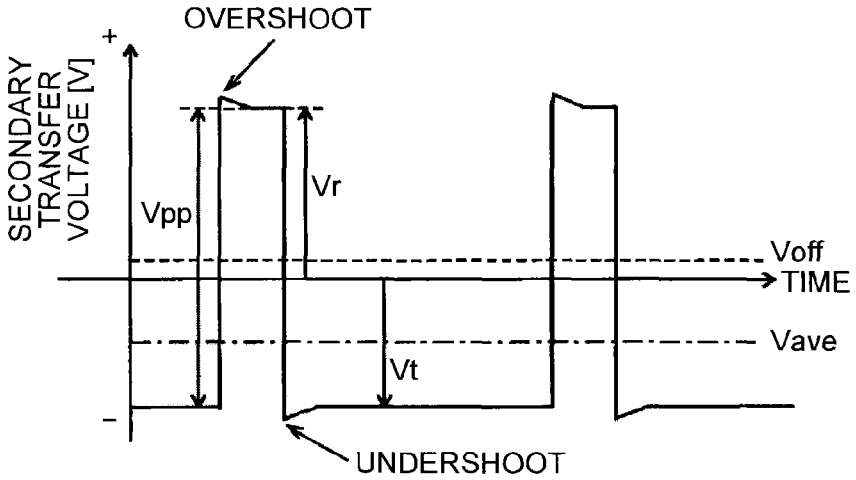
FIG. 15 is a waveform chart illustrating a voltage waveform of a secondary transfer voltage that causes overshoot and undershoot.
Figure 16:
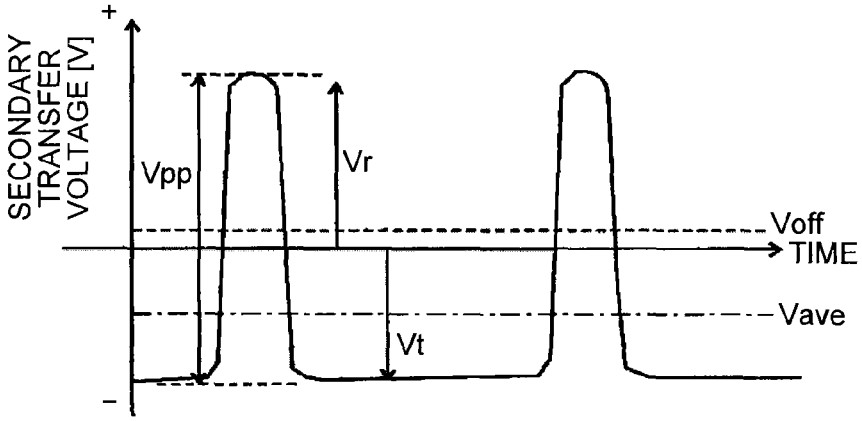
FIG. 16 is a waveform chart illustrating a voltage waveform of a secondary transfer voltage that can improve the overshoot and the undershoot.

It is to be noted that if overshoot or undershoot as illustrated in FIG. 15 is generated on the voltage waveform of the secondary transfer voltage, the peak value Vr of the return voltage and the peak value Vt of the supply voltage (a peak value Ir of the return current and a peak value It of the supply current in the case of the constant current control) increase rather than they should be for only a moment. This arises a risk that electric discharge is generated at the time of the overshoot or the undershoot and slight white spots are generated. In order to solve the problem, the secondary transfer power supply 39 is configured so as to output a voltage having such a waveform that corners of a rectangular shape are chamfered as illustrated in FIG. 16 preferably. With this, even if the overshoot or the undershoot is generated, the peak value of the return voltage and the peak value of the supply voltage can be suppressed to be lower than values at which electric discharge is generated. It is to be noted that in the specification, the rectangular wave indicates a wave having a waveform in which a period at a peak value is equal to or higher than 60% of the total in each of the application periods of the return voltage and the supply voltage.

First Waveform Example of Secondary Transfer Voltage

The waveform of the secondary transfer voltage is not limited to that illustrated in FIG. 10 and various waveforms can be employed.

Figure 17:
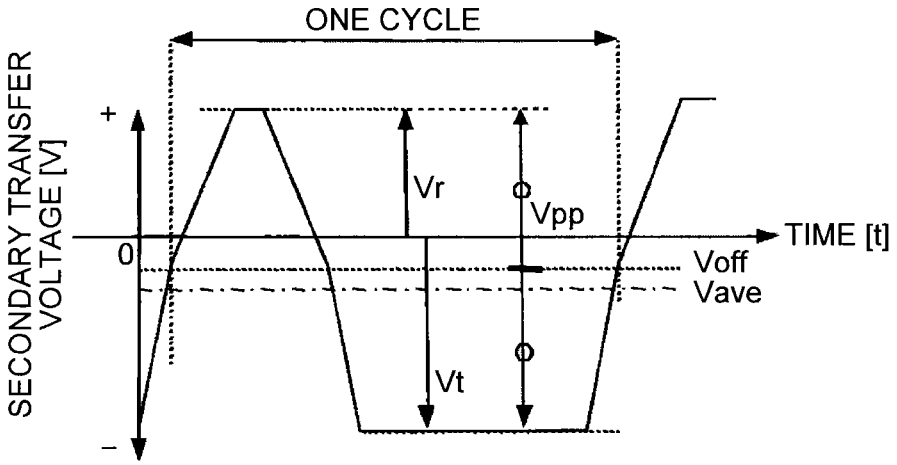
FIG. 17 is a graph illustrating the waveform of a secondary transfer voltage in a first waveform example.

FIG. 17 is a graph illustrating the waveform of a secondary transfer voltage in a first waveform example.

The waveform of the secondary transfer voltage has a trapezoidal wave shape in which rising and trailing inclinations of the return voltage are made smaller than rising and trailing inclinations of the supply voltage.

Second Waveform Example of Secondary Transfer Voltage

Figure 18:
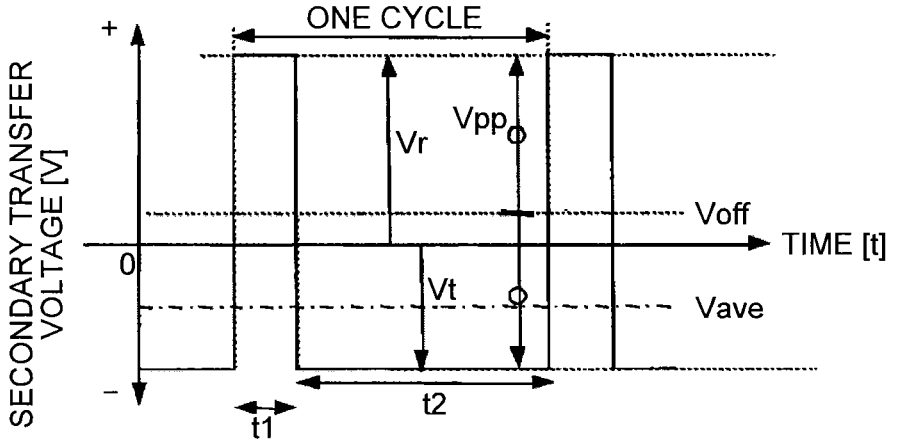
FIG. 18 is a graph illustrating the waveform of a secondary transfer voltage in a second waveform example.

FIG. 18 is a graph illustrating the waveform of a secondary transfer voltage in a second waveform example.

The secondary transfer voltage is a pulse wave in which an area at the side of the positive polarity is smaller than an area at the side of the negative polarity with respect to the offset voltage Voff of the AC component as in the waveform in the embodiment illustrated in FIG. 10. In other words, the secondary transfer voltage is a pulse wave in which the return voltage application period t1 is shorter than the supply voltage application period t2. In the second waveform example, a return time ratio is lower than that in the waveform in the embodiment illustrated in FIG. 10.

Third Waveform Example of Secondary Transfer Voltage

Figure 19:
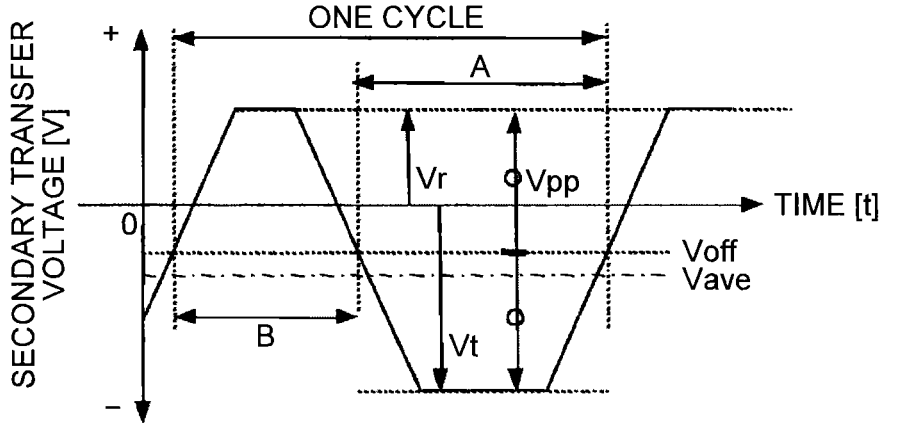
FIG. 19 is a graph illustrating the waveform of a secondary transfer voltage in a third waveform example.

FIG. 19 is a graph illustrating the waveform of a secondary transfer voltage in a third waveform example.

The waveform of the secondary transfer voltage has a trapezoidal wave shape as in the waveform in the first waveform example illustrated in FIG. 17. In the third waveform example of the secondary transfer voltage, a period B at the side of the positive polarity is shorter than a period A at the side of the negative polarity with respect to the offset voltage Voff of the AC component. It is to be noted that in the waveform in the above-mentioned first waveform example, the period A at the side of the negative polarity and the period B at the side of positive polarity have the same length with respect to the offset voltage Voff of the AC component. In the third waveform example, a ratio of the period B in one cycle (period A+period B) is 45%.

Fourth Waveform Example of Secondary Transfer Voltage

Figure 20:
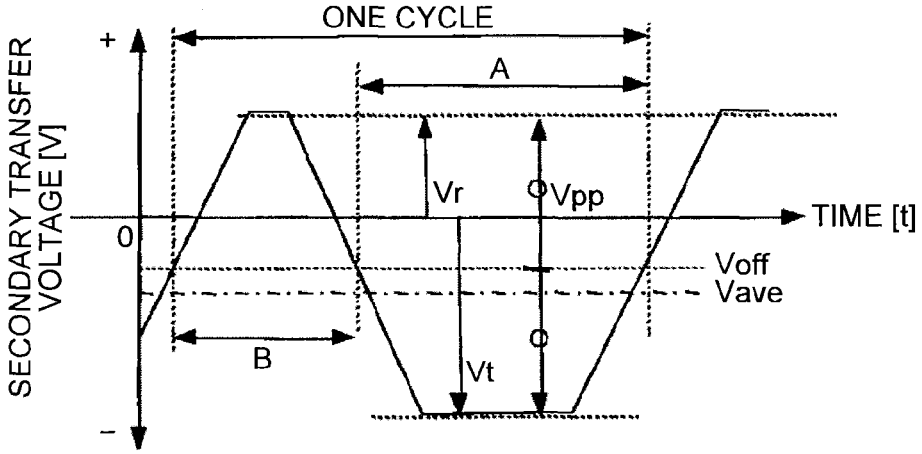
FIG. 20 is a graph illustrating the waveform of a secondary transfer voltage in a fourth waveform example.

FIG. 20 is a graph illustrating the waveform of a secondary transfer voltage in a fourth waveform example.

The waveform of the secondary transfer voltage has a trapezoidal wave shape in which the period B at the side of the positive polarity is shorter than the period A at the side of the negative polarity with respect to the offset voltage Voff of the AC component as in the above-mentioned third waveform example. In the fourth waveform example, a ratio of the period B in one cycle (period A+period B) is 40%.

Fifth Waveform Example of Secondary Transfer Voltage

Figure 21:
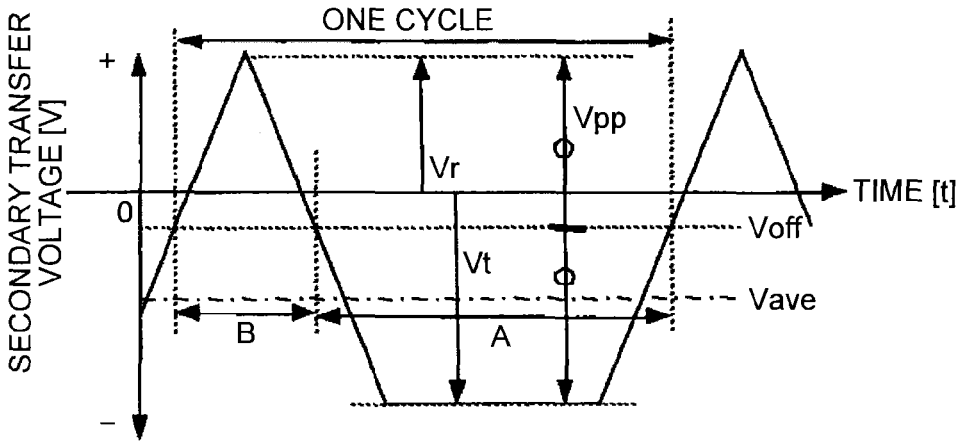
FIG. 21 is a graph illustrating the waveform of a secondary transfer voltage in a fifth waveform example.

FIG. 21 is a graph illustrating the waveform of a secondary transfer voltage in a fifth waveform example.

The waveform of the secondary transfer voltage has a shape in which the period B at the side of the positive polarity is shorter than the period A at the side of the negative polarity with respect to the offset voltage Voff of the AC component, the waveform in the period A at the side of the negative polarity has a trapezoidal wave shape, and the waveform in the period B at the side of the positive polarity has a triangular wave shape. In the fifth waveform example, a ratio of the period B in one cycle (period A+period B) is 32%.

Sixth Waveform Example of Secondary Transfer Voltage

Figure 22:
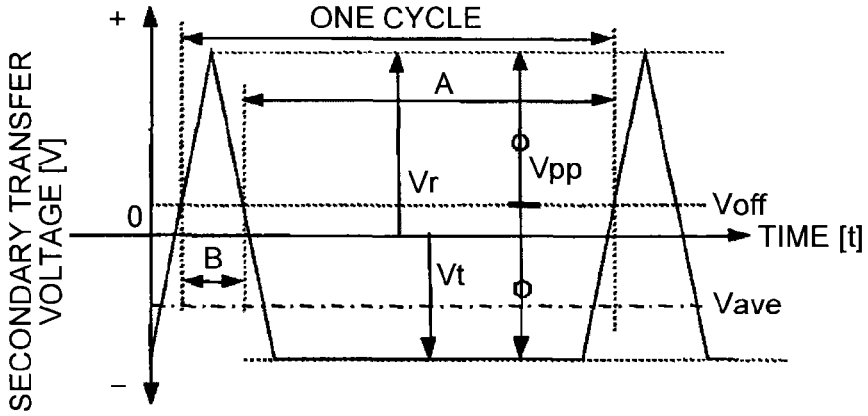
FIG. 22 is a graph illustrating the waveform of a secondary transfer voltage in a sixth waveform example.

FIG. 22 is a graph illustrating the waveform of a secondary transfer voltage in a sixth waveform example.

The waveform of the secondary transfer voltage is the waveform similar to that in the above-mentioned fifth waveform example. In the sixth waveform example, a ratio of the period B in one cycle (period A+period B) is 16%.

Seventh Waveform Example of Secondary Transfer Voltage

Figure 23:
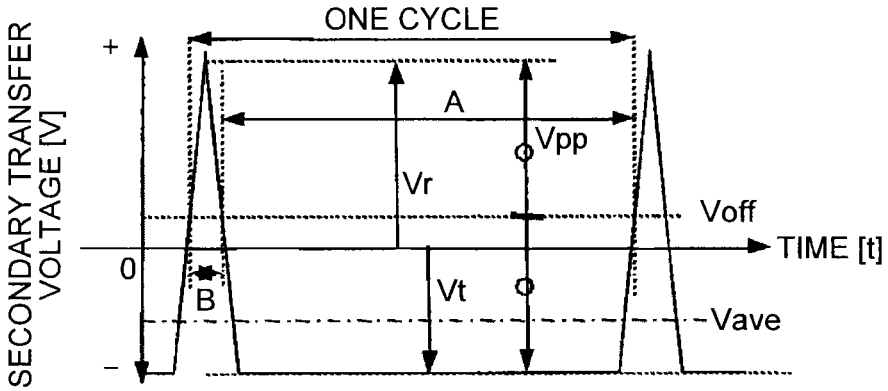
FIG. 23 is a graph illustrating the waveform of a secondary transfer voltage in a seventh waveform example.

FIG. 23 is a graph illustrating the waveform of a secondary transfer voltage in a seventh waveform example.

The waveform of the secondary transfer voltage is the waveform similar to those in the above-mentioned fifth and sixth waveform examples. In the seventh waveform example, a ratio of the period B in one cycle (period A+period B) is 8%.

Eighth Waveform Example of Secondary Transfer Voltage

Figure 24:
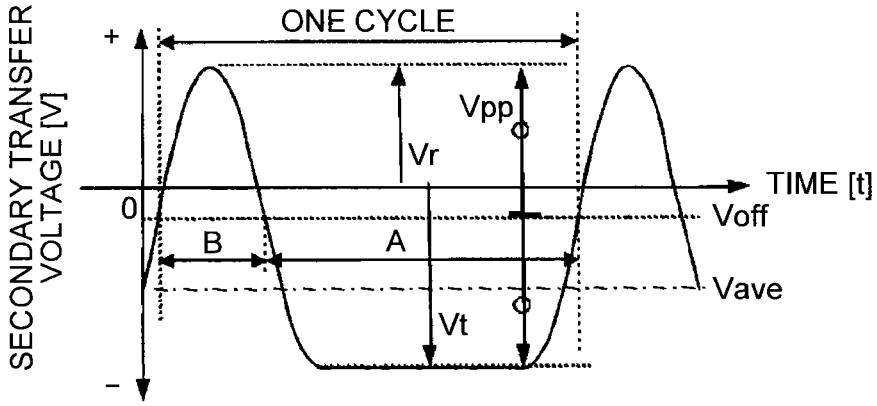
FIG. 24 is a graph illustrating the waveform of a secondary transfer voltage in an eighth waveform example.

FIG. 24 is a graph illustrating the waveform of a secondary transfer voltage in an eighth waveform example.

The waveform of the secondary transfer voltage has a shape in which the period B at the side of the positive polarity is shorter than the period A at the side of the negative polarity with respect to the offset voltage Voff of the AC component and the waveform thereof is rounded. In the eighth waveform example, a ratio of the period B in one cycle (period A+period B) is 16%.

Ninth Waveform Example of Secondary Transfer Voltage

When the thickness and the material of the recording sheet P in the secondary transfer nip are different, the resistance of the intermediate transfer belt 31, the secondary transfer opposing roller 33, or the secondary transfer roller 36 changes over time, and so on, so that electric capacity in the secondary transfer nip is changed, it is considered that the waveform of the secondary transfer voltage is changed. For example, when the electric capacity of the secondary transfer nip is small, electric charges that have been applied once are leaked so as to generate a voltage drop. Under the assumption of this case, voltage waveforms calculated by expecting cases where the electric capacity of the secondary transfer nip is low and high with a power supply whose maximum output current is low are obtained preferably.

Figure 25:
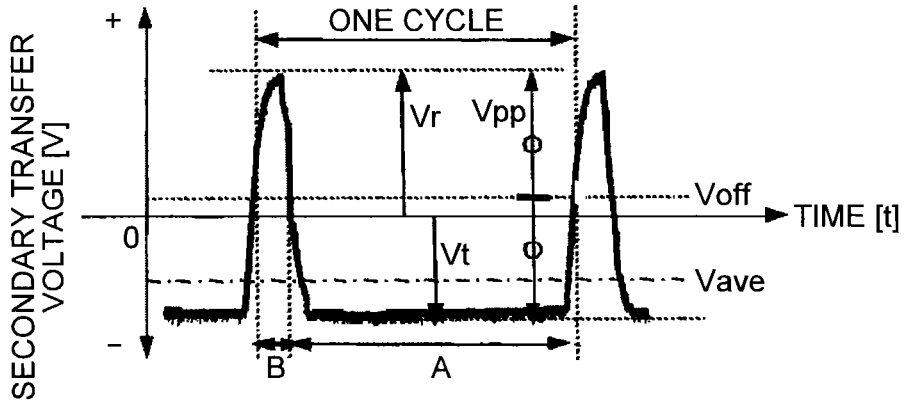
FIG. 25 is a graph illustrating the waveform of a secondary transfer voltage in a ninth waveform example.

FIG. 25 is a graph illustrating the waveform of a secondary transfer voltage in a ninth waveform example.

The waveform of the secondary transfer voltage is a voltage waveform obtained by expecting the electric capacity (electrostatic capacity) in the secondary transfer nip N to be 170 pF, and expecting the resistance value to be 17 MΩ. In the ninth waveform example, the return time ratio is 12%.

Tenth Waveform Example of Secondary Transfer Voltage

Figure 26:
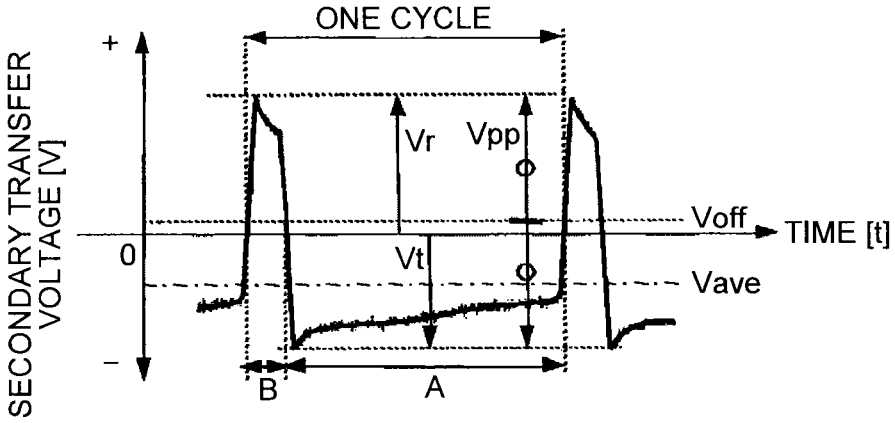
FIG. 26 is a graph illustrating the waveform of a secondary transfer voltage in a tenth waveform example.

FIG. 26 is a graph illustrating the waveform of a secondary transfer voltage in a tenth waveform example.

The waveform of the secondary transfer voltage is obtained by expecting the electric capacity (electrostatic capacity) in the secondary transfer nip N to be 120 pF, and expecting the resistance value to be 15 MΩ. In the tenth waveform example, the return time ratio is 12%.

The above-described embodiment is a mere example and has specific effects.

Aspect A

A transfer device includes a nip forming member such as the secondary transfer roller 36 that abuts against a front surface of an image carrier such as the intermediate transfer belt 31 carrying a toner image so as to form a transfer nip such as a secondary transfer nip, and a transfer voltage application unit such as the secondary transfer power supply 39 that applies a transfer voltage such as a secondary transfer voltage to the transfer nip, the transfer voltage including a DC component and an AC component for transferring the toner image on the image carrier onto a recording material such as a recording sheet P nipped in the transfer nip. In the transfer device, when the toner image on the image carrier is transferred onto the recording material, the transfer voltage is an alternating voltage in which a supply voltage having polarity (negative polarity) in the transfer direction in which the toner image is transferred onto the recording material from the image carrier and a return voltage having polarity (positive polarity) opposite to the supply voltage are switched alternately. Furthermore, in the transfer device, a time average value Vave of the transfer voltage is set to be at the polarity (negative polarity) in the transfer direction in which the toner image is transferred onto the recording material from the image carrier and is set to be closer to a peak value Vr of the supply voltage relative to an offset voltage Voff as a center value between a maximum value and a minimum value of the transfer voltage. In addition, the absolute value of a peak value Vt of the return voltage is set to be larger than the absolute value of the time average value Vave.

With this, when an image is formed on a recording material with large surface irregularities, sufficient transfer performance can be obtained on both the recesses and the protrusions on a surface of the recording material without generating white spots (white out) in the image.

Aspect B

In the aspect A, the transfer voltage is set such that an application period t2 of the supply voltage in one cycle is the same as or longer than an application period t1 of the return voltage in one cycle.

With this, the absolute value of the peak value Vt of the supply voltage can be suppressed to be low in comparison with a case where the application period t2 of the supply voltage in one cycle is shorter than the application period t1 of the return voltage in one cycle. This makes it easy to suppress generation of electric discharge in the transfer nip, whereby generation of white spots (white out) in an image due to the electric discharge can be suppressed effectively.

Aspect C

In the aspect B, the transfer voltage is set such that a ratio (return time ratio) of the application period t1 of the return voltage in one cycle is equal to or higher than 8%.

As described in the above-mentioned second experiment, the return time ratio is at least equal to or higher than 8%, so that toner having entered the recesses on the paper surface can be returned to the intermediate transfer belt preferably and it is easy to obtain a sufficient image density on the recesses.

Aspect D

In the aspect C, the transfer voltage is set such that the application period t1 of the return voltage in one cycle is equal to or longer than 0.03 ms.

As described in the above-mentioned third experiment, the application period t1 of the return voltage is set to be at least equal to or longer than 0.03 ms. With this, insufficiency of the image density on the recesses of the paper surface that is generated when the application period t1 of the return voltage is too short can be avoided.

Aspect E

In any one of the aspects B to D, the transfer voltage is set such that a ratio (return time ratio) of the application period t1 of the return voltage in one cycle is equal to or lower than 24%.

With this, as indicated in Table 3, even under the hardest temperature and humidity conditions (10°, 15%), an evaluation of equal to or higher than Rank 3.5 mentioned above can be obtained.

Aspect F

In any one of the aspects A to E, the transfer voltage is set such that a relation between a frequency f Hz of the AC component, a nip width d mm of the transfer nip in an image carrier surface movement direction, and a surface movement speed v mm/s of the image carrier satisfies "$f>(4/d)\times v$".

With this, as described in the above-mentioned fourth experiment, even if the alternating voltage is employed as the secondary transfer voltage, an image on which pith unevenness due to influence of the alternating electric field in the secondary transfer nip is not generated can be obtained.

Aspect G

In any one of the aspects A to F, the transfer voltage application unit outputs the DC component under constant current control.

With this, as described above, margin of setting of a control target value that can respond to thick paper as well as paper having a normal thickness can be made larger in comparison with a case where the DC component is output under constant voltage control.

Aspect H

An image forming apparatus includes a transfer unit that transfers a toner image carried on a surface of an image carrier onto a recording material nipped into a transfer nip formed by abutment between the image carrier and a nip forming member. In the image forming apparatus, the transfer device according to any one of the aspects A to G is used as the transfer unit.

With this, when an image is formed on the recording material with large irregularities, a sufficient image density can be obtained on both the recesses and the protrusions on the surface of the recording material without generating white spots (white out) in the image.

As described above, can be provided an excellent effect of obtaining sufficient image densities on both the recesses and the protrusions on a surface of a recording material with large surface irregularities without generating white spots (white out) on an image when the image is formed on the recording material.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries a toner image;

a nip forming member that forms a transfer nip between the image carrier and the nip forming member; and a power supply that outputs a transfer voltage in which an AC component is superimposed on a DC component to transfer the toner image from the image carrier onto a sheet at the transfer nip, wherein the transfer voltage is switched alternately between a first peak value Vt having a first polarity to move the toner image from the image carrier onto the sheet and a second peak value Vr having a second polarity that is opposite to the first polarity, wherein an absolute value of a time average value Vave of the transfer voltage is larger than an absolute value of a center value Voff between the first peak value Vt and the second peak value Vr, wherein an absolute value of the second peak value Vr is larger than the absolute value of the time average value Vave, and wherein the transfer voltage is set such that a relation between a frequency f Hz of the AC component, a nip width d mm of the transfer nip in an image carrier surface movement direction, and a surface movement speed v mm/s of the image carrier satisfies the following equation 1:

$$f<(4/d)\times v \quad (1).$$

2. The image forming apparatus according to claim 1, wherein the power supply outputs a return voltage having the second polarity for an application period in one cycle, and a ratio of the application period to one cycle is lower than 50%.

3. The image forming apparatus according to claim 2, the ratio of the application period to one cycle is equal to or lower than 32%.

4. The image forming apparatus according to claim 3, the ratio of the application period to one cycle is equal to or lower than 24%.

5. The image forming apparatus according to claim 4, the ratio of the application period to one cycle is equal to or lower than 16%.

6. The image forming apparatus according to claim 5, the ratio of the application period to one cycle is equal to or higher than 8%.

7. The image forming apparatus according to claim 2, the application period is equal to or longer than 0.03 ms.

8. The image forming apparatus according to claim 1, wherein the power supply outputs the DC component under constant current control.

9. The image forming apparatus according to claim 1, wherein the center value Voff has the second polarity.

10. The image forming apparatus according to claim 1, wherein the image carrier is an intermediate transfer belt.

11. The image forming apparatus according to claim 10, further comprising an opposing roller disposed opposing to the nip forming member via the intermediate transfer belt at the transfer nip.

12. The image forming apparatus according to claim 11, wherein the power supply outputs the transfer voltage to the opposing roller.

13. The image forming apparatus according to claim 11, wherein the nip forming member is a secondary transfer roller.

14. The image forming apparatus according to claim 1, wherein the nip forming member is a transfer roller.

15. The image forming apparatus according to claim 1, wherein an absolute value of the first peak value Vt is different than the absolute value of the second peak value Vr and the absolute value of the center value Voff is greater than zero.

16. The image forming apparatus according to claim 15, wherein the absolute value of the first peak value Vt is less than the absolute value of the second peak value Vr.

17. The image forming apparatus according to claim 15, wherein the absolute value of the first peak value Vt is greater than the absolute value of the second peak value Vr.

18. A transfer method of transferring a toner image, comprising:

forming an image on an image carrier; and applying a transfer bias to cause toner particles of the image to reciprocate between the image carrier and a recess of a sheet;

wherein the transfer bias is switched alternately between a first peak value Vt having a first polarity to move the toner particles from the image carrier onto the sheet and a second peak value Vr having a second polarity that is opposite to the first polarity, wherein a duration of the first peak value Vt in one cycle is longer than that of the second peak value Vr in one cycle, and wherein the transfer bias is set such that a relation between a frequency f Hz of an AC component, a nip width d mm of a transfer nip in an image carrier surface movement direction, and a surface movement speed v mm/s of the image carrier satisfies the following equation 1:

$$f<(4/d)\times v \quad (1).$$

19. A transfer method of transferring a toner image, comprising:

forming an image on an image carrier; and applying a transfer bias to cause toner particles of the image to reciprocate between the image carrier and a recess of a sheet;

wherein the transfer bias is switched alternately between a first peak value Vt having a first polarity to move the toner particles from the image carrier onto the sheet and a second peak value Vr having a second polarity that is opposite to the first polarity, wherein an absolute value of a time average value Vave of the transfer bias is larger than an absolute value of a center value Voff between the first peak value Vt and the second peak value Vr, and wherein the transfer bias is set such that a relation between a frequency f Hz of an AC component, a nip width d mm of the transfer nip in an image carrier surface movement direction, and a surface movement speed v mm/s of the image carrier satisfies the following equation 1:

$$f<(4/d)\times v \quad (1).$$

* * * * *